US007748147B2

(12) United States Patent
Schoenmaker et al.

(10) Patent No.: US 7,748,147 B2
(45) **Date of Patent: *Jul. 6, 2010**

(54) AUTOMATED CONTROL OF BOOM OR ATTACHMENT FOR WORK VEHICLE TO A PRESENT POSITION

(75) Inventors: Dennis Eric Schoenmaker, Fonthill (CA); Mark Peter Sahlin, Bettendorf, IA (US); Jason Meredith, Tuscola, IL (US); Jerry Anthony Samuelson, Lynn Center, IL (US); David August Johnson, Moline, IL (US); Eric Richard Anderson, Galena, IL (US)

(73) Assignee: Deere & Company, Moline, IL (US)

( * ) Notice: Subject to any disclaimer, the term of this patent is extended or adjusted under 35 U.S.C. 154(b) by 313 days.

This patent is subject to a terminal disclaimer.

(21) Appl. No.: 11/778,802

(22) Filed: Jul. 17, 2007

(65) Prior Publication Data

US 2008/0263908 A1 Oct. 30, 2008

Related U.S. Application Data

(60) Provisional application No. 60/914,967, filed on Apr. 30, 2007.

(51) Int. Cl.
*E02F 5/02* (2006.01)
*G05D 1/04* (2006.01)

(52) U.S. Cl. ..... 37/348; 37/382; 414/699; 701/50

(58) Field of Classification Search ..... 37/348, 37/382, 396, 907; 701/50; 414/699; 172/4.5
See application file for complete search history.

(56) References Cited

U.S. PATENT DOCUMENTS 3,643,828 A 2/1972 Elliott (Continued)

FOREIGN PATENT DOCUMENTS

EP 0801174 10/1997

(Continued)

OTHER PUBLICATIONS

USPTO final office action for U.S. Appl. No. 11/778812 dated Mar. 18, 2010.

*Primary Examiner*—Thomas A Beach
(74) *Attorney, Agent, or Firm*—Yee & Associates, P.C.; Marilyn Smith Dawkins

(57) ABSTRACT

A method and system for automated operation of a work vehicle comprises a boom having a first end and a second end opposite the first end. A first hydraulic cylinder is associated with the boom. A first sensor detects a boom angle of a boom with respect to a support near the first end. An attachment is coupled to the second end of the boom. A second sensor detects an attachment angle of attachment with respect to the boom. A second cylinder is associated with the attachment. A switch accepts a command to move to or enter a preset position from another position. A controller controls the first hydraulic cylinder to attain a boom angle within a target boom angular range and for controlling the second cylinder to attain an attachment angle within a target attachment angular range associated with the preset position in response to the command.

25 Claims, 15 Drawing Sheets

U.S. PATENT DOCUMENTS 4,015,729 A * 4/1977 Parquet et al. ..... 414/694
4,288,196 A * 9/1981 Sutton, II ..... 414/699
4,630,685 A * 12/1986 Huck et al. ..... 172/7
4,844,685 A * 7/1989 Sagaser ..... 414/700
4,864,746 A * 9/1989 Fukumoto ..... 37/414
4,964,779 A * 10/1990 Sagaser ..... 414/708
5,000,650 A 3/1991 Brewer et al.
5,257,177 A 10/1993 Bach et al.
5,361,211 A 11/1994 Lee et al.
5,490,081 A 2/1996 Kuromoto et al.
5,528,843 A 6/1996 Rocke
5,598,648 A * 2/1997 Moriya et al. ..... 37/348
5,629,849 A * 5/1997 Ahn ..... 701/50
5,701,691 A * 12/1997 Watanabe et al. ..... 37/348
5,826,666 A * 10/1998 Tozawa et al. ..... 172/7
5,835,874 A * 11/1998 Hirata et al. ..... 701/50
5,890,870 A * 4/1999 Berger et al. ..... 414/699
5,899,008 A * 5/1999 Cobo et al. ..... 37/348
5,903,988 A 5/1999 Tochizawa et al.
5,957,989 A * 9/1999 Egawa et al. ..... 701/50
5,968,103 A 10/1999 Rocke
5,968,104 A * 10/1999 Egawa et al. ..... 701/50
5,974,352 A 10/1999 Shull
6,064,933 A 5/2000 Rocke
6,115,660 A * 9/2000 Berger et al. ..... 701/50
6,140,787 A 10/2000 Lokhorst et al.
6,205,687 B1 3/2001 Rocke
6,208,925 B1 * 3/2001 Creger et al. ..... 701/51
6,211,471 B1 4/2001 Rocke et al.
6,233,511 B1 * 5/2001 Berger et al. ..... 701/50
6,317,669 B1 * 11/2001 Kurenuma et al. ..... 701/50
6,321,153 B1 11/2001 Rocke et al.
6,336,067 B1 * 1/2002 Watanabe et al. ..... 701/50
6,371,214 B1 * 4/2002 Anwar et al. ..... 172/1
6,405,114 B1 6/2002 Priestley et al.
6,609,315 B1 * 8/2003 Hendron et al. ..... 37/348
6,618,659 B1 9/2003 Berger et al.
6,691,437 B1 * 2/2004 Yost et al. ..... 37/348
6,766,600 B2 * 7/2004 Ogura et al. ..... 37/348
6,879,899 B2 4/2005 Budde
6,968,241 B2 * 11/2005 Vonnoe et al. ..... 700/61
6,968,264 B2 * 11/2005 Cripps ..... 701/50
7,634,863 B2 12/2009 Stanek et al.
2002/0073833 A1 6/2002 Coombs et al.
2003/0001751 A1 * 1/2003 Ogura et al. ..... 340/691.6
2003/0019132 A1 1/2003 Kurenuma et al.
2006/0245896 A1 11/2006 Alshaer et al.
2008/0177450 A1 * 7/2008 Daniel ..... 701/50
2009/0222176 A1 * 9/2009 Florean et al. ..... 701/50

FOREIGN PATENT DOCUMENTS

GB 2243359 10/1991
GB 2327078 1/1999

* cited by examiner

AUTOMATED CONTROL OF BOOM OR ATTACHMENT FOR WORK VEHICLE TO A PRESENT POSITION

This document (including all of the drawings) claims the benefit of U.S. Provisional Application No. 60/914,967, filed on Apr. 30, 2007 under 35 U.S.C. 119(e).

FIELD OF THE INVENTION

This invention relates to an automated control of a boom or attachment for a work vehicle to a preset position.

BACKGROUND OF THE INVENTION

A work vehicle may be equipped for a boom and attachment attached to the boom. A work task may require repetitive or cyclical motion of the boom or the attachment. Where limit switches or two-state position sensors are used to control the motion of the boom or attachment, the work vehicle may produce abrupt or jerky movements in automated positioning of the boom or attachment. The abrupt or jerky movements produce unwanted vibrations and shock that tend to reduce the longevity of hydraulic cylinders and other components. Further, the abrupt or jerky movements may annoy an operator of the equipment. Accordingly, there is need to reduce or eliminate abrupt or jerky movements in automated control of the boom, attachment, or both.

In the context of a loader as the work vehicle where the attachment is a bucket, an automated control system may return the bucket to a ready-to-dig position or generally horizontal position after completing an operation (e.g., dumping material in the bucket). However, the control system may not be configured to align a boom to a desired boom height. Thus, there is a need for a control system that simultaneously supports movement of the attachment (e.g., bucket) and the boom to a desired position (e.g., ready-to-dig position).

SUMMARY OF THE INVENTION

A method and system for automated operation of a work vehicle comprises a boom having a first end and a second end opposite the first end. A first hydraulic cylinder is associated with the boom. A first sensor detects a boom angle of a boom with respect to a support (or the vehicle) near the first end. An attachment is coupled to the second end of the boom. A second sensor detects an attachment angle of attachment with respect to the boom. A second cylinder is associated with the attachment. A switch accepts a command to move to or enter a preset position from another position. A controller controls the first hydraulic cylinder to attain a boom angle within a target boom angular range and for controlling the second cylinder to attain an attachment angle within a target attachment angular range associated with the preset position in response to the command.

BRIEF DESCRIPTION OF THE DRAWINGS

Like reference numbers in different drawings indicate like elements, steps or procedures.

DESCRIPTION OF THE PREFERRED EMBODIMENT

Figure 1:
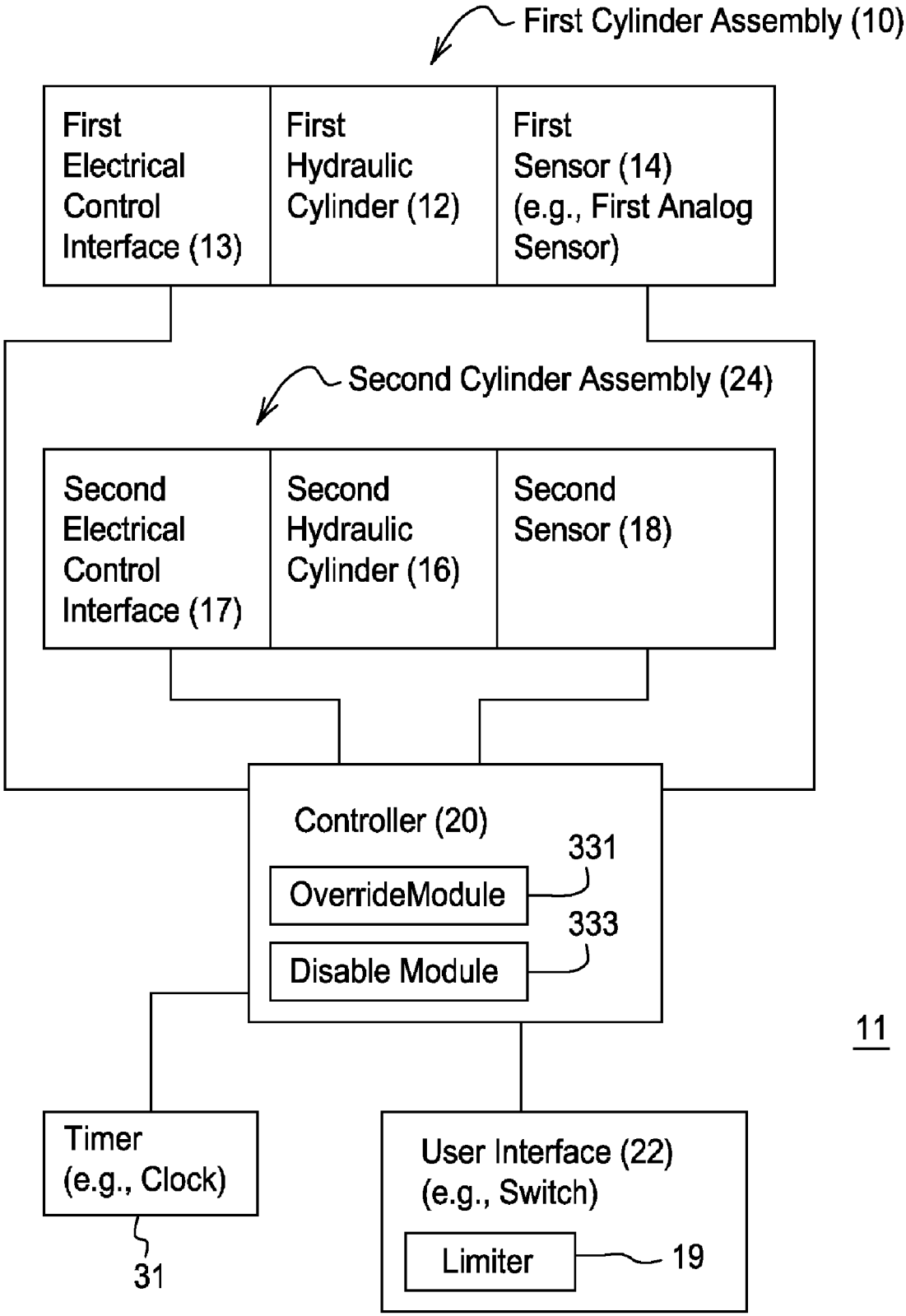
FIG. 1 is a block diagram of one embodiment of a control system for a boom and an attachment of a work vehicle.

In accordance with one embodiment, FIG. 1 illustrates a control system 11 for automated operation of a work vehicle. The control system 11 comprises a first cylinder assembly 10 and a second cylinder assembly 24 that provide a sensor signal or sensor data to a controller 20. The first cylinder assembly 10 comprises the combination of a first hydraulic cylinder 12, a first sensor 14, and a first electrical control interface 13. Similarly, the second cylinder assembly 24 comprises the combination of a second hydraulic cylinder 16, a second sensor 18, and a second electrical control interface 17. A timer 31 (e.g., clock) provides a time reference or pulse train to the controller 20 such that control data or control signals to the first electrical control interface 13 and the second electrical control interface 17 are properly modulated or altered over time to attain proper or desired movement of the attachment, the boom, or both. The controller 20 communicates with a user interface 22. The user interface 22 comprises a switch, a joystick, a keypad, a control panel, a keyboard, a pointing device (e.g., mouse or trackball) or another device that supports the operator's input and/or output of information from or to the control system 11.

Figure 2:
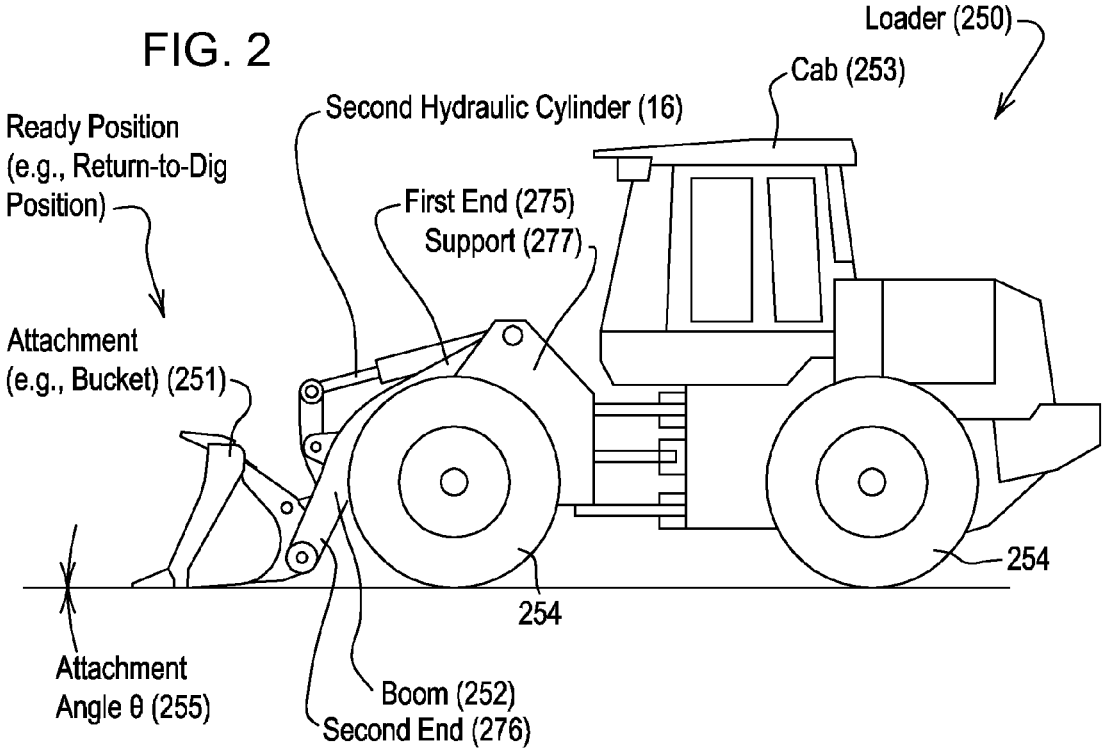
FIG. 2 is a diagram of a side view of a loader as an illustrative work vehicle, where the loader is in one preset position (e.g., return-to-dig position).

In accordance with FIG. 1 and FIG. 2, a boom 252 has a first end 275 and a second end 276 opposite the first end 275. The first hydraulic cylinder 12 is associated with the boom. The first hydraulic cylinder 12 is arranged to move the boom 252 by changing a position (e.g., first linear position) of a first movable member (e.g., rod or piston) of the first hydraulic cylinder 12. To move the boom 252 or hold the boom 252 steady in a desired position, the controller 20 sends a control signal or control data to the first electrical control interface 13. The first electrical control interface 13 may comprise an electromechanical valve, an actuator, a servo-motor, a solenoid or another electrically controlled device for controlling or regulating hydraulic fluid associated with the first hydraulic cylinder 12. The first sensor 14 detects a boom angle of a boom 252 with respect to a support (or vehicle) or detects the first linear position of a first movable member associated with the first hydraulic cylinder 12. An attachment (e.g., bucket 251) is coupled to the second end 276 of the boom 252.

The second hydraulic cylinder 16 is associated with attachment 251. As shown in FIG. 2, a linkage links or operably connects the second hydraulic cylinder 16 to the attachment 251, although other configurations are possible and fall within the scope of the claims. The second hydraulic cylinder 16 is arranged to move the attachment 251 by changing a linear position (e.g., second linear position) of a movable member (e.g., rod or piston) of the second hydraulic cylinder 16. To move the boom 252 or hold the attachment 251 in a desired position, the controller 20 sends a control signal or control data to the second electrical control interface 17. The second electrical control interface 17 may comprise an electromechanical valve, an actuator, a servo-motor, a solenoid or another electrically controlled device for controlling or regulating hydraulic fluid associated with the second hydraulic cylinder 16. A second sensor 18 detects an attachment angle of attachment 251 with respect to the boom 252 or detects the linear position of a movable member associated with the second hydraulic cylinder 16.

The first sensor 14 and the second sensor 18 may be implemented in various alternative configurations. Under a first example, the first sensor 14, the second sensor 18, or both comprise potentiometers or rotary potentiometers that change resistance with a change in an angular position. Rotary potentiometers may be mounted at or near joints or hinge points, such as where the attachment 251 rotates with respect to the boom 252, or where the boom 252 rotates with respect to another structure (e.g., 277) of the vehicle.

Under a second example, the first sensor 14, the second sensor 18, or both comprise linear potentiometers that change resistance with a corresponding change in linear position. In one embodiment, a rod of a hydraulic cylinder (e.g., first hydraulic cylinder 12 or second hydraulic cylinder 16) may be hollow to accommodate the mounting of a linear potentiometer therein. For example, the hollow rod may be equipped with a variable resistor with a wiper, or variable resistor with an electrical contact that changes resistance with rod position.

Under a third example, the first sensor 14, the second sensor 18 or both may comprise magnetostrictive sensors, a magnetoresistive sensor, or magnetic sensor that changes resistance or another electrical property in response to a change in magnetic field induced by a permanent magnet or an electromagnet. The magnetic sensor and a magnet or electromagnet may be mounted on different members near a hinge points to detect relative rotational or angular displacement of the members. Alternately, the magnet or electromagnet may be associated with or mounted on a movable member of the hydraulic cylinder (e.g., the first hydraulic cylinder 12 or the second hydraulic cylinder 16.)

Under a fourth example, the first sensor 14, the second sensor 18 or both may comprise analog sensors, digital sensors, or other sensors for detecting an angular position (e.g., of the boom 252 or the attachment 251) over a defined range. Analog sensors may support continuous position information over the defined range, whereas the digital sensor may support discrete position information within the defined range. If the digital sensor (e.g., limit switch or reed switch) only provides a two-state output indicating the boom or attachment is in desired position or not in a desired position, such a digital sensor alone is not well-suited for maintaining a desired or graduated movement versus time curve.

Under a fifth example, the first sensor 14, the second sensor 18 or both comprise ultrasonic position detectors, magnetic position detectors, or optical position detectors, or other sensors for detecting a linear position of a movable member of the first hydraulic cylinder 12, the second hydraulic cylinder 16, or both.

In a sixth example, the first sensor 14 is integrated into the first hydraulic cylinder 12. For example, the first hydraulic cylinder 12 comprises a cylinder rod with a magnetic layer and the first sensor 14 senses a first magnetic field (or a digital or analog recording) recorded on the magnetic layer to estimate the boom angle. Similarly, the second sensor 18 is integrated into the second hydraulic cylinder 16. In such a case, the second hydraulic cylinder 12 may comprise a cylinder rod with a magnetic layer, where the second sensor 18 senses a second magnetic field (or a digital or analog recording) recorded on the magnetic layer to estimate the attachment angle.

In an seventh example, the first sensor 14 and the second sensor 18 each are integrated into a hydraulic cylinder (e.g., first hydraulic cylinder 12 or the second hydraulic cylinder 16) with a hollow rod. For example, the hollow rod may be associated with an ultrasonic position detector that transmits an ultrasonic wave or acoustic wave and measures the time of travel associated with its reflection or another property of ultrasonic, acoustic or electromagnetic propagation of the wave within the hollow rod.

In an eighth example, the first sensor 14 comprises a linear position sensor mounted in tandem with the first hydraulic cylinder 12, and the second sensor 18 comprises a linear position sensor mounted in tandem with the second hydraulic cylinder 16. In the eighth example, the linear position sensor may comprise one or more of the following: a position sensor, an angular position sensor, a magnetostrictive sensor, a magnetoresistive sensor, a resistance sensor, a potentiometer, an ultrasonic sensor, a magnetic sensor, and an optical sensor.

For any of the above examples, the first position sensor 14 or the second position sensor 18 may be associated with a protective shield. For instance, for a linear position sensor mounted in tandem with the first hydraulic cylinder 12 or the second hydraulic cylinder 16, the protective shield may comprise a cage, a frame, metallic mesh, a longitudinal metal member with two longitudinal seams or folds, or another protective shield. The protective shield extends in a longitudinal direction and may be connected or attached to at least a portion of the first hydraulic cylinder 12 or the second hydraulic cylinder 16.

In an alternate embodiment, the protective shield is telescopic, has bellows, or is otherwise made of two movable members that engage each other. Accordingly, such a protective shield may be connected to both ends of the respective hydraulic member, or any supporting structures, associated therewith or adjacent thereto.

As used herein, a preset position or preset position state comprise one or more of the following positions of a boom, an attachment, or both: a lower boom position, an elevated boom position, a bucket curl position, a material-carrying or level position of a bucket or attachment, a ready-to-dig position, a ready position, a return-to-dig position, a curl position of an attachment (e.g., bucket), a lower ready-to-dig position, an elevated ready-to-dig position, a lower curl position (e.g., for transportation of material in a bucket), an elevated curl position, a ready-to-dump position, a dump position, a lower dump position, and an elevated dump position, a first operational position, a second operational position, among other possibilities. Each of the preset positions may be defined by one or more of the following: a preset boom angle, a preset attachment angle, a preset bucket angle, a preset boom angular range, a preset attachment angular range, a preset bucket angular range, an attachment angle, an attachment angular range, a boom angle, and a boom angular range, a boom position, a boom position range, an attachment position, and an attachment position range. The preset position may be defined by an operator, defined as a factory setting, or programmed or reprogrammed in the field (e.g., via optical, electromagnetic, wireless, telematic or electrical communication). Various examples of preset positions will be described in greater detail in FIG. 2 through FIG. 5, for example.

In one embodiment, the user interface 22 comprises one or more switches for accepting a command to move to a preset position or enter a preset position state (e.g., return-to-dig position) from another position or position state (e.g., dump position, curl position, or another operational position). The command may refer to the activation or deactivation of the switch by an operator. For example, if the switch comprises a joystick controller 20, in one embodiment the command (e.g., and accompanying command data) is initiated by moving a handle of the joystick controller 20 to a defined detent position for a minimum duration. The operator may establish or select the boom angle or target boom angular range via an entry or input into the user interface 22. For example, the operator may enter or select a desired ready height of the attachment, a default or factory setting for the desired ready height of the attachment, or a target boom angular range. The target boom angular range may be based on the desired ready height of the attachment defined by the operator. In one embodiment, the user interface 22 supports manual override, interruption, ceasing, or recall of a recently entered or in progress return-to-position command. For example, the user interface 22 and controller 20 (e.g., the override module 331) may be programmed to stop the return-to-position movement of the boom 252, attachment 251, or both upon the receipt of the operator's manual input (e.g., via the joystick or user interface) during a return-to-position movement previously or inadvertently activated by the operator.

The user interface 22, the controller 20, or both may comprise a limiter 19 for limiting the permitted preset positions of the boom, the attachment, or both. In a first example, the limiter 19 limits the desired ready height to an upper height limit. The limiter 19 may limit the upper limit height to prepare for another work task, to prepare for digging into material, or to avoid raising the center of gravity of the work vehicle above a maximum desired level. In a second example, the limiter 19 may limit the desired ready height to a range between an upper height limit and a lower height limit. In a third example, the limiter may prevent an operator for establishing a preset position where a cutting edge of the attachment (e.g., bucket) is positioned below the ground. This prohibition prevents the attachment from digging into the ground or damaging surfaces during transportation. In a fourth example, the limiter 19 prevents an operator from establishing a preset position where an attachment (e.g., bucket) is rolled back more than a maximum rollback angle (e.g., approximately sixty degrees) at less than maximum height of the boom (e.g., above the mast height of the boom). For example, the maximum permitted rollback angle for a corresponding preset position may vary with the boom height, such that the maximum rollback is approximately sixty degrees at the mast height of the boom and is reduced as the boom height increases to a limit of approximately forty degrees at full height of the boom. The rollback angle refers to one or more of the following: (a) the angle at which the attachment or bucket is fully curled or approaches a fully curled state, (b) the angle where the second hydraulic cylinder 16 is fully contracted or approaches a fully contracted state, or (c) opposite of the maximum dumping angle. In a fifth example, the limiter 19 prevents an operator from establishing a preset position where a cutting edge or leading edge of the attachment (e.g., bucket) is on the ground and the bucket is dumped more than a maximum dump angle (e.g., approximately eighty degrees). The maximum dump angle refers to one or more of the following: (a) the angle at which the attachment or bucket is fully dumped, (b) the angle where the second hydraulic cylinder 16 is fully extended, or (c) opposite of the maximum rollback angle. This prohibition prevents an extremely high bucket cylinder pressure from forward or back blading with the work vehicle in a stationary position.

The controller 20 comprises an override module 331 and a disable module 333. The override module 331 allows an operator to cease control of the movement (or control) of the boom and the attachment and to interrupt any command (e.g., return-to-position command or a go-to preset position command) or automated movement of the attachment or boom. For example, the override module 331 allows an operator to cease control of the movement of the boom and attachment by entering, inputting or otherwise interacting (e.g., moving a joystick) with the user interface 22 in a manual operator input mode, as opposed to an automated control mode. In the automated control mode, the controller 20 controls the entire movement and path (e.g., optimized movement and path) of the boom or attachment between an initial position and a preset position activated by the operator, whereas in the manual operator input mode the controller 20 follows the operator's instantaneous physical input or operator's movement (e.g., manipulation of a joystick by the operator's fingers, hand, wrist and/or arm) via the user interface 22 to move the boom and attachment as substantially inputted or directed by the operator. The override module 331 supports intervention for safety reasons or otherwise, for instance.

The disable module 333 is arranged to disable, interrupt, or exit from the automated control mode and enter a manual control mode, if a disabling condition is met or satisfied. Under a first example, a disabling condition is met or satisfied where the boom or attachment does not reach a preset position (e.g., preset boom angle, a preset attachment angle, or both) after the expiration of a maximum time duration. Under a second example, a disabling condition is met or satisfied where a ground speed of the vehicle exceeds a maximum threshold ground speed. The foregoing disabling conditions and other disabling conditions may be selected to facilitate machine health, longevity, and avoid stress or strain on the hydraulic systems and other components of the vehicle.

The controller 20 supports one or more of the following: (1) measurement or determination of position, velocity or acceleration data associated with the boom, the attachment, or both, and (2) control of the boom and the attachment via the first hydraulic cylinder and the second hydraulic cylinder, respectively, based on the at least one of the determined position, velocity and acceleration data. The foregoing functions of the controller may be carried out in accordance with various techniques, which may be applied alternately or cumulatively. Under a first technique, the controller 20 controls the first hydraulic cylinder 12 to attain a target boom angular range and controls the second cylinder to attain a target attachment angular range associated with the preset position state in response to the command. Under a second technique, the controller 20 controls the first hydraulic cylinder 12 to attain a target boom position and controls the second cylinder to attain a target attachment position associated with the preset position state in response to the command. Under a third technique, the controller controls the first hydraulic cylinder and the second hydraulic cylinder to move the boom and the attachment simultaneously. Under a fourth technique, the controller may determine or read a first linear position of the first cylinder, a second linear position of the second cylinder, an attachment angle between the attachment and the boom, or a boom angle between a vehicle (or a support) and the boom. Under a fifth technique, the controller may determine or read a first linear position versus time of the first cylinder (i.e., a first linear velocity), a second linear position versus time of a the second cylinder (i.e., a second linear velocity), an attachment angle versus time between the attachment and the boom (i.e., an attachment angular velocity), or a boom angle versus time between a vehicle (or a support) and the boom (i.e., a boom angular velocity). Under a sixth technique, the controller may be arranged to take a first derivative of the first linear velocity, the second linear velocity, the attachment angular velocity or the boom angular velocity to determine or estimate the acceleration of deceleration of the boom, the attachment, or both.

Under a seventh technique, the controller 20 or disable module 333 may disable the return-to-position movement of the boom, the attachment, or both if the boom and the attachment do not reach the preset position within a maximum time duration (e.g., determined by the timer 31) after activation. For example, if the boom or attachment does not reach the boom present angle or the attachment preset angle within a maximum time duration (e.g., 5 seconds), controller 20 or disable module 333 may cancel the return-to-position command or authorization and the controller 20 and user interface 22 will revert back to manual control mode (e.g., awaiting further input from the operator). The seventh technique may prevent damage to the first hydraulic cylinder, the second hydraulic cylinder, or both or other mechanical components of the work vehicle, if the work vehicle is operating at maximum lift capacity or breakout capacity and cannot reach the preset position within a maximum time duration (e.g., because the bucket is stuck in a pile of material).

Under an eighth technique, the controller 20 or disable module 333 may disable activation of the return-to-position movement of the boom, the attachment, or both for a time duration if the vehicle ground speed exceeds a predetermined or established threshold maximum speed (e.g., 15 kilometers per hour). A speed sensor may communicate the ground speed to the controller via a databus (controller area network (CAN) databus), for instance.

In FIG. 2 through FIG. 5, the work vehicle comprises a loader 250 and the attachment 251 comprises a bucket. Although the loader 250 shown has a cab 253 and wheels 254, the wheels 254 may be replaced by tracks and the cab 253 may be deleted. One or more wheels 254 or tracks of the vehicle are propelled by an internal combustion engine, an electric drive motor, or both. Although FIG. 2 through FIG. 5 illustrate the attachment 251 as a bucket, in other embodiments that attachment may comprise one or more of the following: a bucket, a loader, a grapper, jaws, claws, a cutter, a grapple, an asphalt cutter, an auger, compactor, a crusher, a feller buncher, a fork, a grinder, a hammer, a magnet, a coupler, a rake, a ripper, a drill, shears, a tree boom, a trencher, and a winch. If a grapple is used, its jaws may be opened or closed by a third hydraulic cylinder that a controller opens or closes at one or more preset positions and/or preset times.

FIG. 2 shows side view of a loader 250 as an illustrative work vehicle, where the loader 250 is in a first preset position (e.g., first return-to-dig position). Here, the first preset position is characterized by the attachment angular range or the attachment angle 255 (θ) approaching zero degrees with respect to a generally horizontal axis (e.g., ground). In other words, the first preset position of FIG. 2 illustrates the attachment 251 as a bucket, where a bottom of a bucket is in a generally horizontal position or substantially parallel to the ground. The attachment 251 may be, but need not be, in contact with the ground. The first ready state has a target attachment angular range and a target boom angular range that are consistent with completion of a corresponding return-to-dig procedure, and the start of a new dig cycle.

In an alternate embodiment, the attachment angle 255 may be determined relative to the boom or a boom coordinate system of the boom 252, and the attachment angle may be defined by a positive, negative or neutral angle, consistent with the coordinate system.

Figure 3:
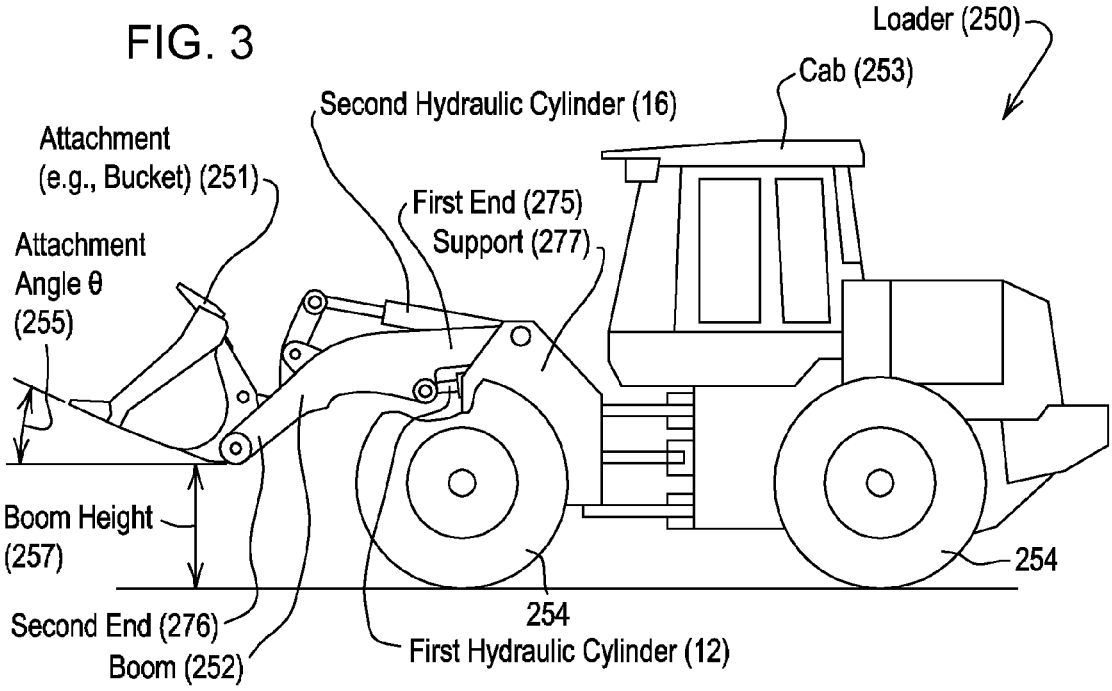
FIG. 3 is a diagram of a side view of a loader as an illustrative work vehicle, where the loader is in another preset position (e.g., return-to-dig position).

FIG. 3 shows side view of a loader 250 as an illustrative work vehicle, where the loader 250 is in a second preset position (e.g., second return-to-dig position). The second preset position of FIG. 3 represents an alternative to the first preset position of FIG. 2. Here, the second preset position is characterized by the attachment angular range or the attachment angle 255 (θ) with respect to a generally horizontal axis or with respect to the boom (e.g., a boom coordinate system). The attachment angle ranges from a minimum angle (e.g., zero degrees with respect to a horizontal axis) to a maximum angle. The operator may select the attachment angle 255 (θ) via the user interface 22 based on the particular task, the height of the pile of material, the size of the pile of material, the material density, or the operator's preferences. Similarly, the boom height 257 is any suitable height selected by an operator. The operator may select the boom height 257 based on the particular task, the height of the pile of material, the size of the pile of material, the material density, or the operator's preferences, subject to any limit imposed by the limiter 19. The second ready state has a target attachment angular range and a target boom angular range that are consistent with the second ready state associated with the completion of a return-to-dig procedure.

In FIG. 3, the target boom height is associated with the target boom angular range or target boom position, where the target boom height is greater than a minimum boom height or a ground level. The target attachment angle 255 is greater than a minimum angle or zero degrees from a horizontal reference axis (e.g., associated with ground level). The target attachment angle 255 falls within the target attachment angular range. The second preset position of FIG. 3 is not restricted to having the attachment 251 (e.g., bucket) in a generally horizontal position as in the first preset position of FIG. 2. Further, providing a slight tilt (e.g., an upward facing tilt of the mouth of the bucket) or attachment angle 255 (θ) of greater than zero may support quicker or more complete filling of the attachment 251 (e.g., bucket) because gravity may force some of the materials into the bucket, for example.

Figure 4:
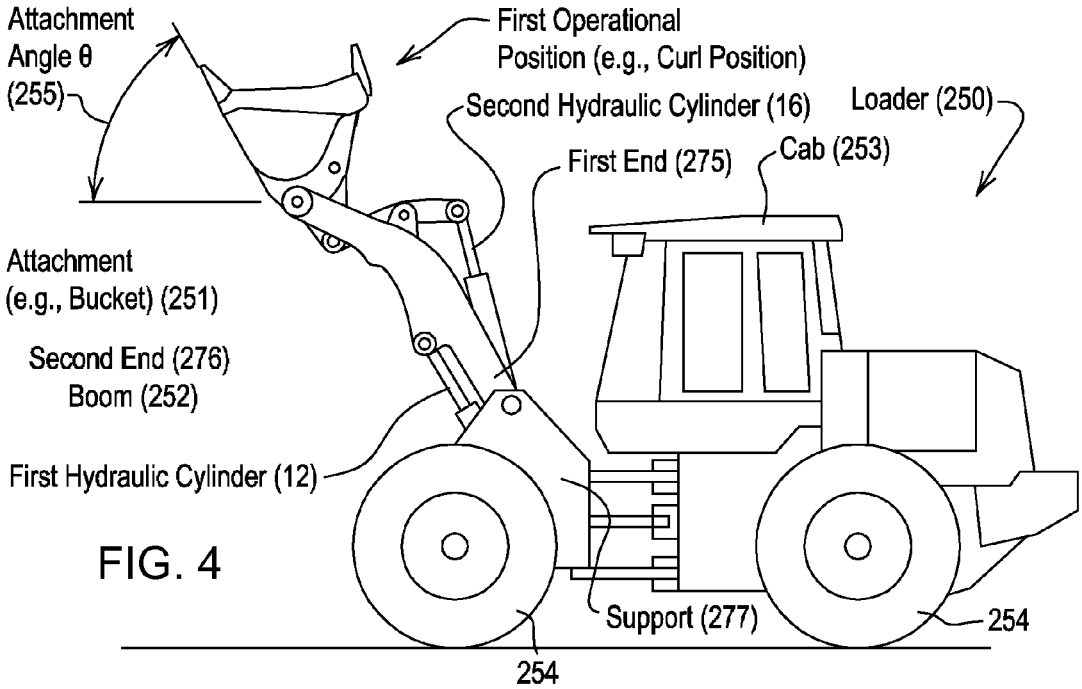
FIG. 4 is a diagram of a side view of a loader as an illustrative work vehicle, where the loader is in a first operational position (e.g., curl position).

FIG. 4 shows a side view of a loader 250 as an illustrative work vehicle, where the loader 250 is in a first operational position (e.g., curl position). The curl position typically represents a position of the attachment 251 (e.g., bucket) after the attachment 251 holds, contains, or possesses collected material. The curl position may be made immediately following a digging process or another maneuver in which the attachment 251 (e.g., bucket) is filled with material. For example, the attachment angle 255 (θ) for the curl position may be from approximately 50 degrees to approximately 60 degrees from a horizontal reference axis.

Figure 5:
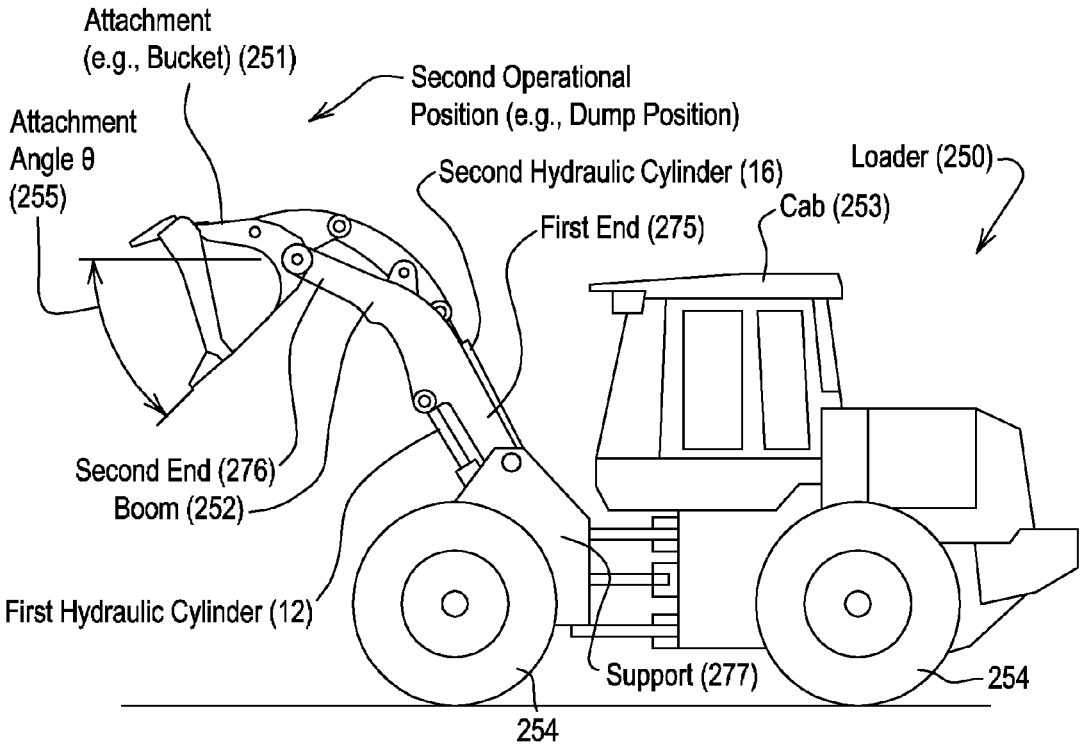
FIG. 5 is a diagram of a side view of a loader as an illustrative work vehicle, where the loader is in a second operational position (e.g., dump position).

FIG. 5 shows a side view of a loader 250 as an illustrative work vehicle, where the loader 250 is in a second operational position (e.g., dump position). The dump position may follow the curl position and is used to deposit material collected in the attachment 251 (e.g., bucket) to a desired spatial location. For example, the dump position may be used to form a pile of material on the ground or to load a dump truck, a railroad car, a ship, a hopper car, a container, a freight container, an intermodal shipping container, or a vehicle. In one example, the attachment angle 255 (θ) for the dump position may be from approximately negative thirty degrees to approximately negative forty-five degrees from a horizontal reference axis as shown in FIG. 5.

Figure 6:
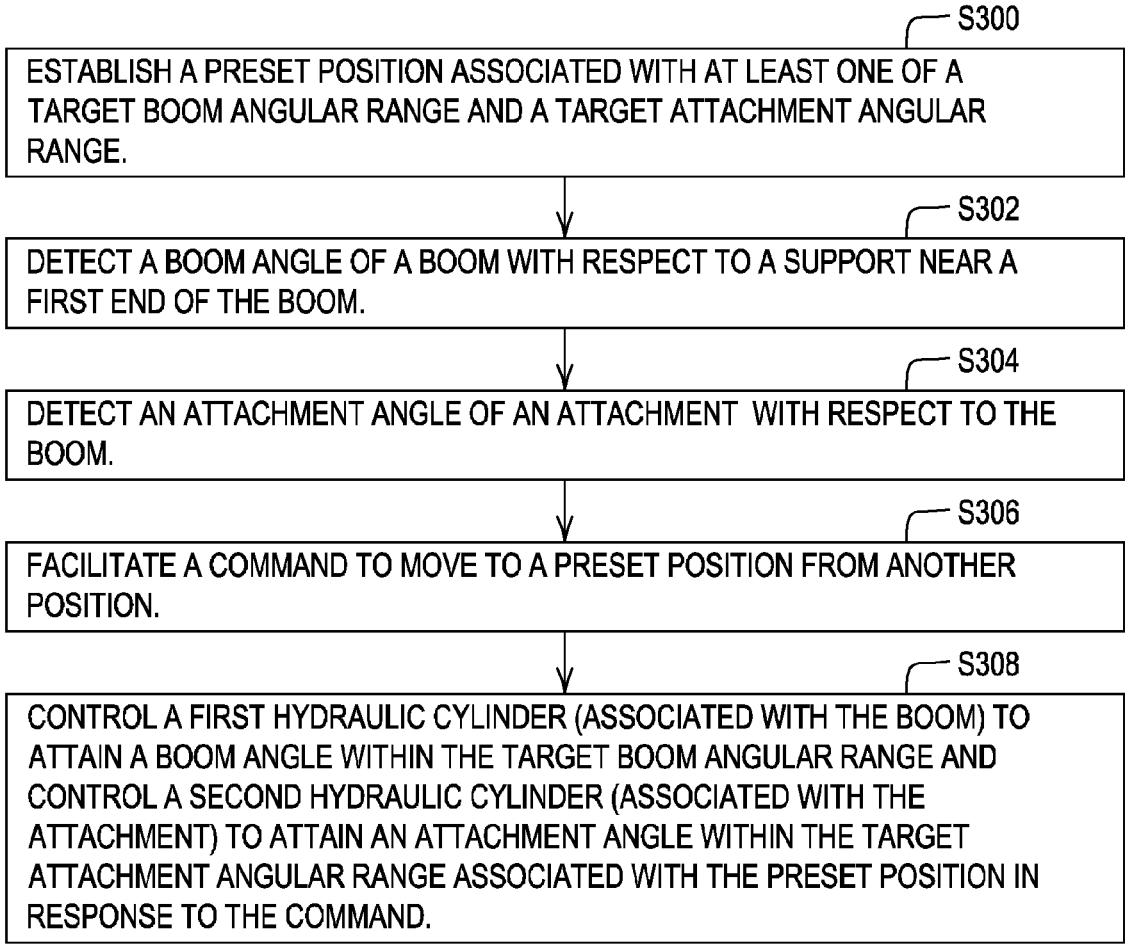
FIG. 6 is a flow chart of a first embodiment of a method for controlling a boom and attachment of a work vehicle.

FIG. 6 relates to a first embodiment of a method for controlling a boom and attachment of a work vehicle. The method of FIG. 6 begins in step S300.

In step S300, a user interface 22 or controller 20 establishes a preset position associated with at least one of a target boom angular range (e.g., target boom angle subject to an angular tolerance) of a boom and a target attachment angular range (e.g., a target attachment angle subject to an angular tolerance) of an attachment. The target boom angular range may be bounded by a lower boom angle and an upper boom angle. Because any boom angle within the target boom angular range is acceptable, the controller 20 has the possibility or flexibility of (a) decelerating the boom 252 within at least a portion of the target boom angular range (or over an angular displacement up to a limit of the target boom angular range) to achieve a desired boom motion curve (e.g., reference boom curve or compensated boom curve segment), and/or (b) shifting a stopping point of the boom for a preset position or a stationary point associated with the boom motion curve within the target boom angular range (or up to a limit of the target boom angular range). In an alternate embodiment, the target boom angular range is defined to be generally coextensive with a particular boom angle or the particular boom angle and an associated tolerance (e.g., plus or minus one tenth of a degree) about it.

The target attachment angular range may be bounded by a lower attachment angle and an upper attachment angle. Because any attachment angle within the target attachment angular range may be acceptable, the controller 20 has the possibility or flexibility of (a) decelerating the attachment 251 within at least a portion of the attachment angular range (or over an angular displacement up to a limit of the target attachment angular range) to achieve a desired attachment motion curve (e.g., a reference attachment curve or compensated attachment curve segment), and/or (b) shifting a stopping point of the attachment or a stationary point associated with the attachment motion curve within the target attachment angular range (or up to a limit of the target attachment angular range). In an alternate embodiment, the target attachment angular range is defined to be generally coextensive with a particular attachment angle alone or the particular attachment angle and an associated tolerance (e.g., plus or minus one tenth of a degree) about it.

In accordance with one implementation of step S300, the controller 20 or the limiter 19 limits the operator's ability to select or enter the preset position based on at least one of the maximum rollback angle of the attachment (e.g., bucket) and the cutting edge position of the attachment. For example, the controller 20 or limiter 19 prevents the operator to select a particular preset position where a maximum rollback angle of the attachment is met or exceeded or where the cutting edge position of the attachment (e.g., bucket) would contact the ground because of the boom position or combined interaction of the boom and bucket positions.

In step S302, a first sensor 14 detects a boom angle of the boom 252 with respect to a support 277 near a first end 275 of the boom 252.

In step S304, a second sensor 18 detects an attachment angle of the attachment 251 with respect to the boom 252.

In step S306, the user interface 22 or controller 20 facilitates a command to move to a preset position from another position (e.g., curl position, dump position, operational position, task position, or digging position). For example, the user interface 22 or controller 20 may facilitate a command to enter the first preset position, the second preset position (e.g., FIG. 3), or another preset position.

In step S308, a controller 20 controls a first hydraulic cylinder 12 (associated with the boom 252) to attain a boom angle (e.g., shifted boom angle) within the target boom angular position and controls the second hydraulic cylinder 16 (associated with the attachment 251) to attain an attachment angle (e.g., a shifted attachment angle) within a target attachment angular position associated with the preset position or preset position state (e.g., first preset position or second preset position state) in response to the command. Step S308 may be carried out in accordance with various techniques, which may be applied alternately and cumulatively Under a first technique, the user interface 22 may allow a user to select an operational mode in which the shifted boom angle, the shifted attachment angle, or both are mandated or such an operational mode may be programmed as a factory setting of the controller 20, for example. The boom angle may comprise a shifted boom angle, if the controller 20 shifts the stopping point of the boom 252 within the target boom angular range. The controller 20 may shift the stopping point of the boom 252 to decelerate the boom 252 to reduce equipment vibrations, to prevent abrupt transitions to the ready state, to avoid breaching a maximum deceleration level, or to conform to a desired boom motion curve (e.g., reference boom curve), for instance. In one configuration, the controller 20 may use the shift in the stopping point to compensate for a lag time or response time of the first hydraulic cylinder 12 or the first cylinder assembly 10.

In accordance with the first technique, the attachment angle may comprise a shifted attachment angle, if the controller 20 shifts the stopping point of the attachment 251 within the attachment angular range. The controller 20 may shift the stopping point of the attachment 251 to decelerate the attachment 251 to reduce equipment vibrations, to prevent abrupt transitions to the ready state, to avoid breaching a maximum deceleration level, or to conform to a desired attachment motion curve (e.g., reference attachment curve or compensated attachment curve segment), for instance. In one configuration, the controller 20 may use the shift in the stopping point to compensate for a lag time or response time of the second hydraulic cylinder 16 or the second cylinder assembly 24.

Under a second technique, the controller 20 controls the first hydraulic cylinder 12 and the second hydraulic cylinder 16 to move the boom 252 and the attachment 251 simultaneously. Under a third technique, the controller 20 controls the first hydraulic cylinder 12 to move the boom 252 to achieve a desired boom motion curve (e.g., reference boom curve or compensated boom curve segment). The desired boom motion curve may comprise a compensated boom motion curve, or a boom motion curve where a maximum deceleration of the boom 252 is not exceeded. Under a fourth technique, the controller 20 controls the second hydraulic cylinder to move the attachment 251 to achieve a desired attachment motion curve (e.g., reference attachment curve or compensated attachment curve segment). The desired attachment motion curve may comprise a compensated attachment motion curve, or an attachment motion curve where a maximum deceleration of the attachment 251 is not exceeded.

Under a fifth technique, the controller 20 or override module 331 overrides the command (e.g., a command issued by the operator to return to a preset position) based on manual input from an operator via the user interface 22 (e.g., an operator's displacement of the joystick or activation of a switch).

Under a sixth technique, the controller 20 or disable module 333 cancels the command (e.g., a command issued by the operator via the user interface to return to a preset position) if the boom or attachment does not reach the preset position within a maximum time duration (e.g., established by the operator or preset as a factory setting). Here, the preset position may be defined as a boom preset angle and an attachment preset angle.

Under a seventh technique, the controller (e.g., controller 120 in FIG. 12 or FIG. 13) or the leveling module (e.g., leveling module 50 in FIG. 12 or FIG. 13) controls an attachment angle of the attachment to maintain the attachment (or a level axis associated therewith) within a target or desired level state when a boom is lowered, raised or held steady. Further, the controller 120 or the leveling module 50 may update control data (to the second cylinder assembly 24 or the second electrical control interface 17) for controlling the attachment angle of the attachment with a minimum update frequency that is proportional to one or more of the following: (a) an angular rate of boom movement of the boom, (b) acceleration of the boom, and (c) velocity of the boom.

Figure 7:
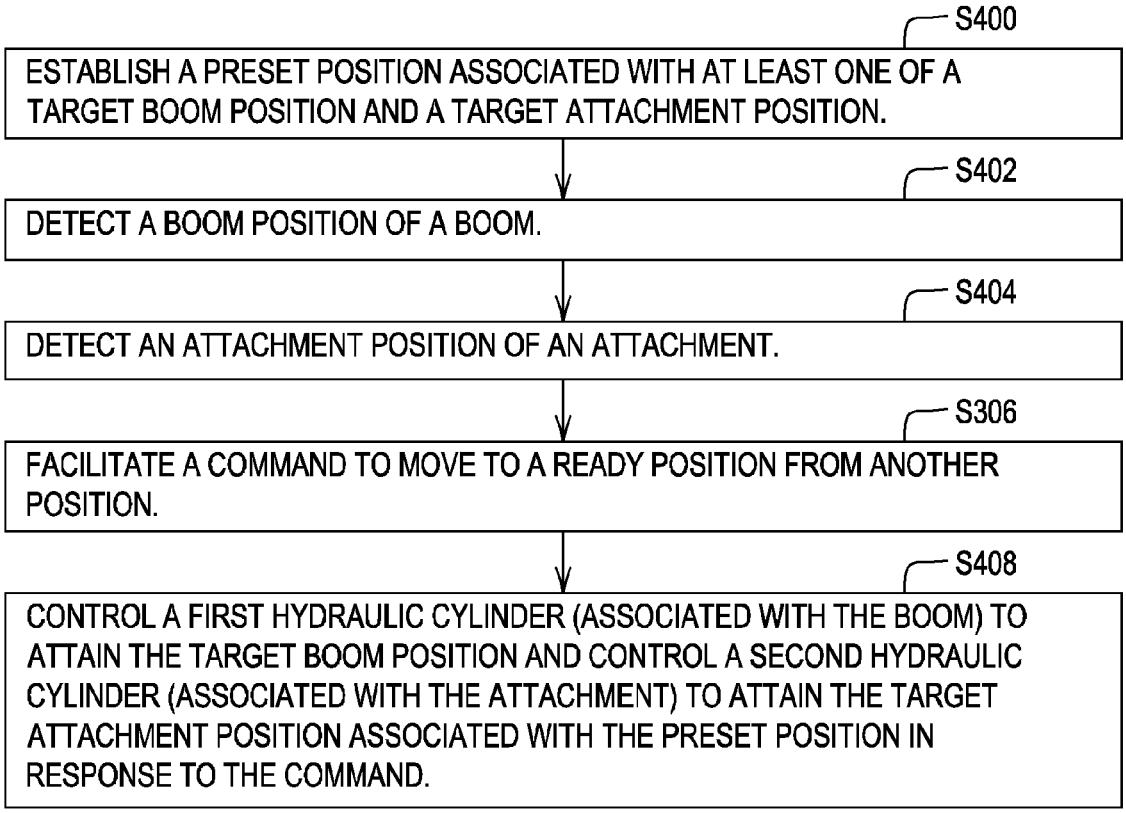
FIG. 7 is a flow chart of a second embodiment of a method for controlling a boom and an attachment of a work vehicle.

FIG. 7 relates to a second embodiment of a method for controlling a boom and attachment of a work vehicle. The method of FIG. 7 begins in step S400.

In step S400, a user interface 22 establishes a preset position associated with at least one of a target boom position and a target attachment position. The target boom position may be associated with a target boom height that is greater than a minimum boom height or ground level. The target attachment position is associated with an attachment angle greater than a minimum angle (e.g., a level bucket where a bottom is generally horizontal) with respect to a generally horizontal axis or with respect to a boom. The minimum angle for the attachment angle may represent zero degrees, or even a negative angle, for instance.

In accordance with one implementation of step S400, the controller 20 or the limiter 19 limits the operator's ability to select or enter the preset position based on at least one of the maximum rollback angle of the attachment (e.g., bucket) and the cutting edge position of the attachment. For example, the controller 20 or limiter 19 prevents the operator to select a particular preset position where a maximum rollback angle of the attachment is met or exceeded or where the cutting edge position of the attachment (e.g., bucket) would contact the ground because of the boom position or combined interaction of the boom and bucket positions.

In step S402, a first sensor 14 detects a boom position of the boom 252 based on a first linear position of a first movable member associated with first hydraulic cylinder 12. The first movable member may comprise a piston, a rod, or another member of the first hydraulic cylinder 12, or a member of a sensor that is mechanically coupled to the piston, the rod, or the first hydraulic cylinder 12.

In step S404, a second sensor 18 detects an attachment position of the attachment 251 based on a second linear position of a second movable member associated with the second hydraulic cylinder 16. The second movable member may comprise a piston, a rod, or another member of the second hydraulic cylinder 16, or a member of a sensor that is mechanically coupled to the piston, the rod, or the second hydraulic cylinder 16.

In step S306, a user interface 22 or controller 20 facilitates a command to move to a preset position from another position. For example, the user interface 22 or controller 20 may facilitate a command to enter the first preset position (e.g., of FIG. 2), the second preset position (e.g., of FIG. 3), or another preset position.

In step S408, a controller 20 controls a first hydraulic cylinder 12 (associated with the boom 252) to attain the target boom position and controls the second hydraulic cylinder 16 (associated with the attachment 251) to attain a target attachment position associated with the preset position in response to the command. Step S408 may be carried out in accordance with various techniques, which may be applied alternately and cumulatively. Under a first technique, the controller 20 controls the first hydraulic cylinder 12 and the second hydraulic cylinder 16 to move the boom 252 and the attachment 251 simultaneously. Under a second technique, the controller 20 controls the first hydraulic cylinder 12 to move the boom 252 to achieve a desired boom motion curve (e.g., reference boom curve or compensated boom motion curve). The desired boom motion curve may comprise a compensated boom motion curve, or a boom motion curve where a maximum deceleration is not exceeded. Under a third technique, the controller controls the second hydraulic cylinder to move the attachment to achieve a desired attachment motion curve. The desired attachment motion curve may comprise a compensated attachment motion curve, or an attachment motion curve where a maximum deceleration of the attachment 251 is not exceeded. Under a fourth technique, in step S408, the controller 20 controls the first hydraulic cylinder 16 to move the boom 252 to achieve a desired boom motion curve (e.g., a compensated boom motion curve); and the controller 20 controls the second hydraulic cylinder 16 to move the attachment 251 to achieve a desired attachment motion curve (e.g., a compensated attachment motion curve).

Under a fifth technique, the controller 20 or override module 331 overrides the command (e.g., a command issued by the operator to return to a preset position) based on manual input from an operator via the user interface 22 (e.g., an operator's displacement of the joystick or activation of a switch).

Under a sixth technique, the controller 20 or disable module 333 cancels the command (e.g., a command issued by the operator via the user interface to return to a preset position) if the boom or attachment does not reach the preset position within a maximum time duration (e.g., established by the operator or preset as a factory setting). Here, the preset position may be defined as a boom preset angle and an attachment preset angle.

Under a seventh technique, the controller (e.g., controller 120 in FIG. 12 or FIG. 13) or the leveling module (e.g., leveling module 50 in FIG. 12 or FIG. 13) controls an attachment angle of the attachment to maintain the attachment (or a level axis associated therewith) within a target or desired level state when a boom is lowered, raised or held steady. Further, the controller 120 or the leveling module 50 may update control data (to the second cylinder assembly 24 or the second electrical control interface 17) for controlling the attachment angle of the attachment with a minimum update frequency that is proportional to one or more of the following: (a) an angular rate of boom movement of the boom, (b) acceleration of the boom, and (c) velocity of the boom.

Figure 8:
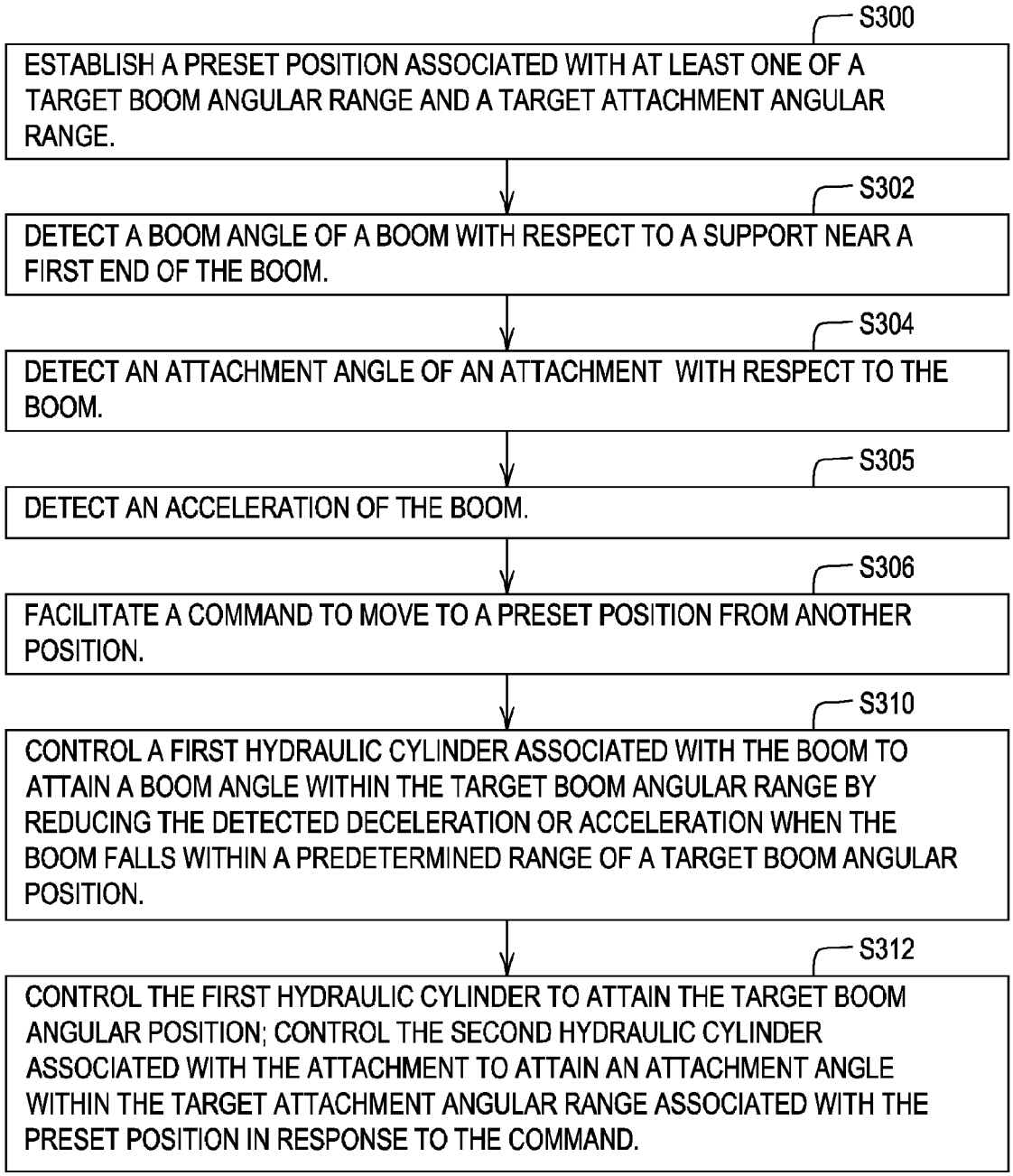
FIG. 8 is a flow chart of a third embodiment of a method for controlling a boom and an attachment of a work vehicle.

FIG. 8 relates to a third embodiment of a method for controlling a boom 252 and attachment 251 of a work vehicle. The method of FIG. 8 begins in step S300.

In step S300, a user interface 22 or controller 20 establishes a preset position associated with at least one of a target boom angular range of a boom 252 and a target angular range of an attachment 251.

In step S302, a first sensor 14 detects a boom angle of the boom 252 with respect to a support near a first end of the boom 252.

In step S304, a second sensor 18 detects an attachment angle of the attachment 251 with respect to the boom 252.

In step S305, an accelerometer or another sensor detects an acceleration of the boom 252.

In step S306, the user interface 22 or controller 20 facilitates a command to move to a preset position from another position for the boom 252 and the attachment 251. For example, the user interface 22 or controller 20 may facilitate a command to enter the first preset position, the second preset position, or another preset position.

In step S310, a controller 20 controls a first hydraulic cylinder 12 (associated with the boom 252) to attain a boom angle within the target boom angular range by reducing the detected deceleration or acceleration when the boom 252 falls within or enters within a predetermined range of the target boom angular position.

In step S312, a controller 20 controls the first hydraulic cylinder 12 to attain the target boom angular range and to control the second hydraulic cylinder 16 (associated with the attachment 251) to attain an attachment angle within the target attachment angular position associated with the preset position in response to the command.

Figure 9:
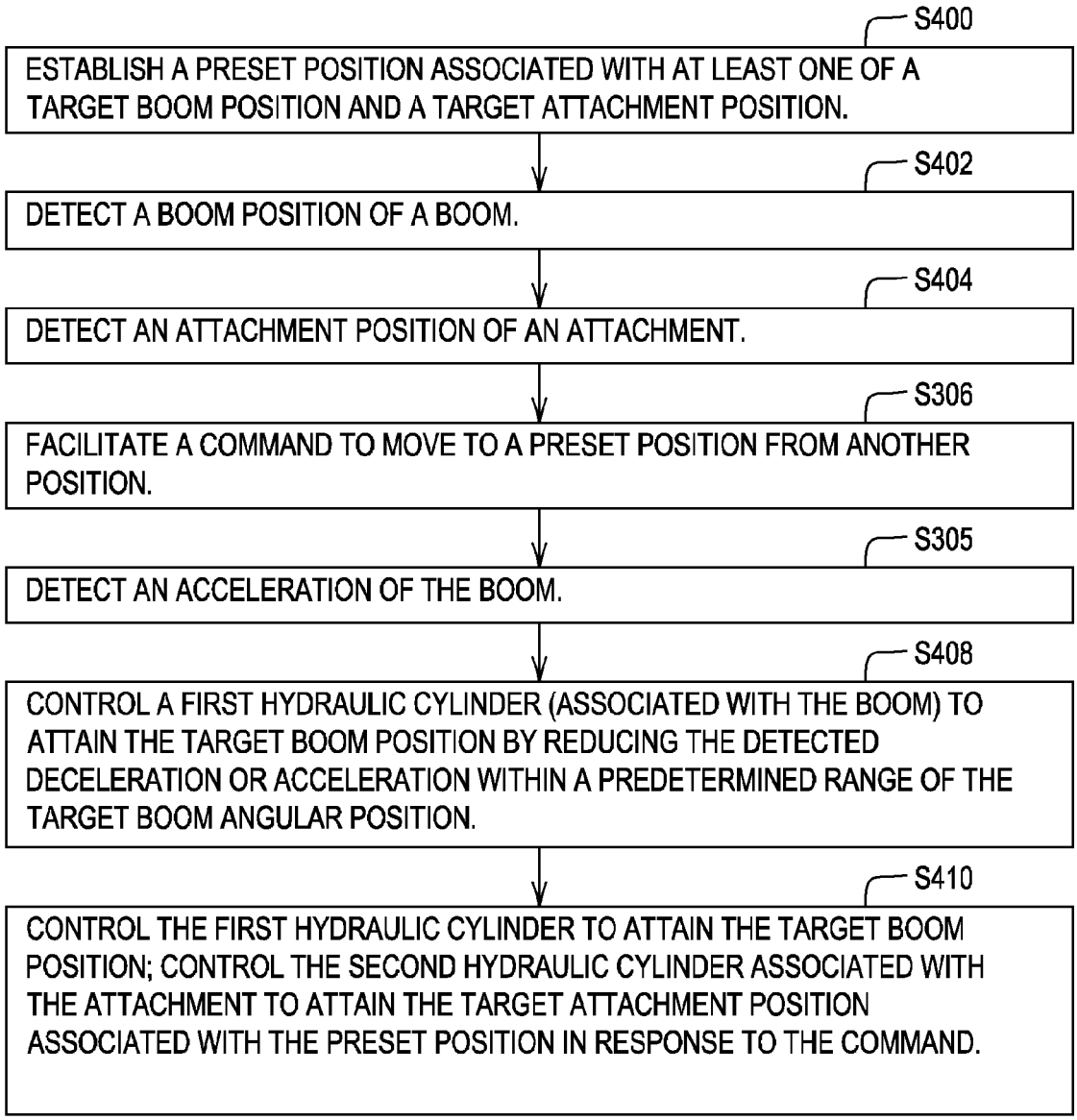
FIG. 9 is a flow chart of a fourth embodiment of a method for controlling a boom and an attachment of a work vehicle.

FIG. 9 relates to a fourth embodiment of a method for controlling a boom 252 and attachment 251 of a work vehicle. The method of FIG. 9 begins in step S400.

In step S400, a user interface 22 establishes a preset position associated with at least one of a target boom position and a target attachment position. The target boom position may be associated with a target boom height that is greater than a minimum boom height or ground level. The target attachment position is associated with an attachment angle greater than a minimum angle or zero degrees (e.g., a level bucket where a bottom is generally horizontal).

In step S402, a first sensor 14 detects a boom position of the boom 252. For example, a first sensor 14 detects a boom position of the boom 252 based on a first linear position of a first movable member associated with first hydraulic cylinder 12. The first movable member may comprise a piston, a rod, or another member of the first hydraulic cylinder 12, or a member of a sensor that is mechanically coupled to the piston, the rod, or the first hydraulic cylinder 12.

In step S404, a second sensor 18 detects an attachment position of the attachment based on a second linear position of a second movable member associated with the second hydraulic cylinder 16. The second movable member may comprise a piston, a rod, or another member of the second hydraulic cylinder 16, or a member of a sensor that is mechanically coupled to the piston, the rod, or the second hydraulic cylinder 16.

In step S306, a user interface 22 or controller 20 facilitates a command to move to a preset position from another position. For example, the user interface 22 or controller 20 may facilitate a command to enter the first preset position, the second preset position, or another preset position.

In step S305, the accelerometer or sensor detects an acceleration or deceleration of the boom.

In step S408, a controller 20 controls a first hydraulic cylinder 12 (associated with the boom 252) to attain the target boom position by reducing the detected acceleration or deceleration when the boom 252 falls within or enters within a predetermined range of the target boom angular position.

In step S410, a controller 20 controls the first hydraulic cylinder 12 to attain the target boom position of the boom 252; and controls the second hydraulic cylinder 16 (associated with the attachment 251) to attain the target attachment position associated with the preset position in response to the command.

Figure 10:
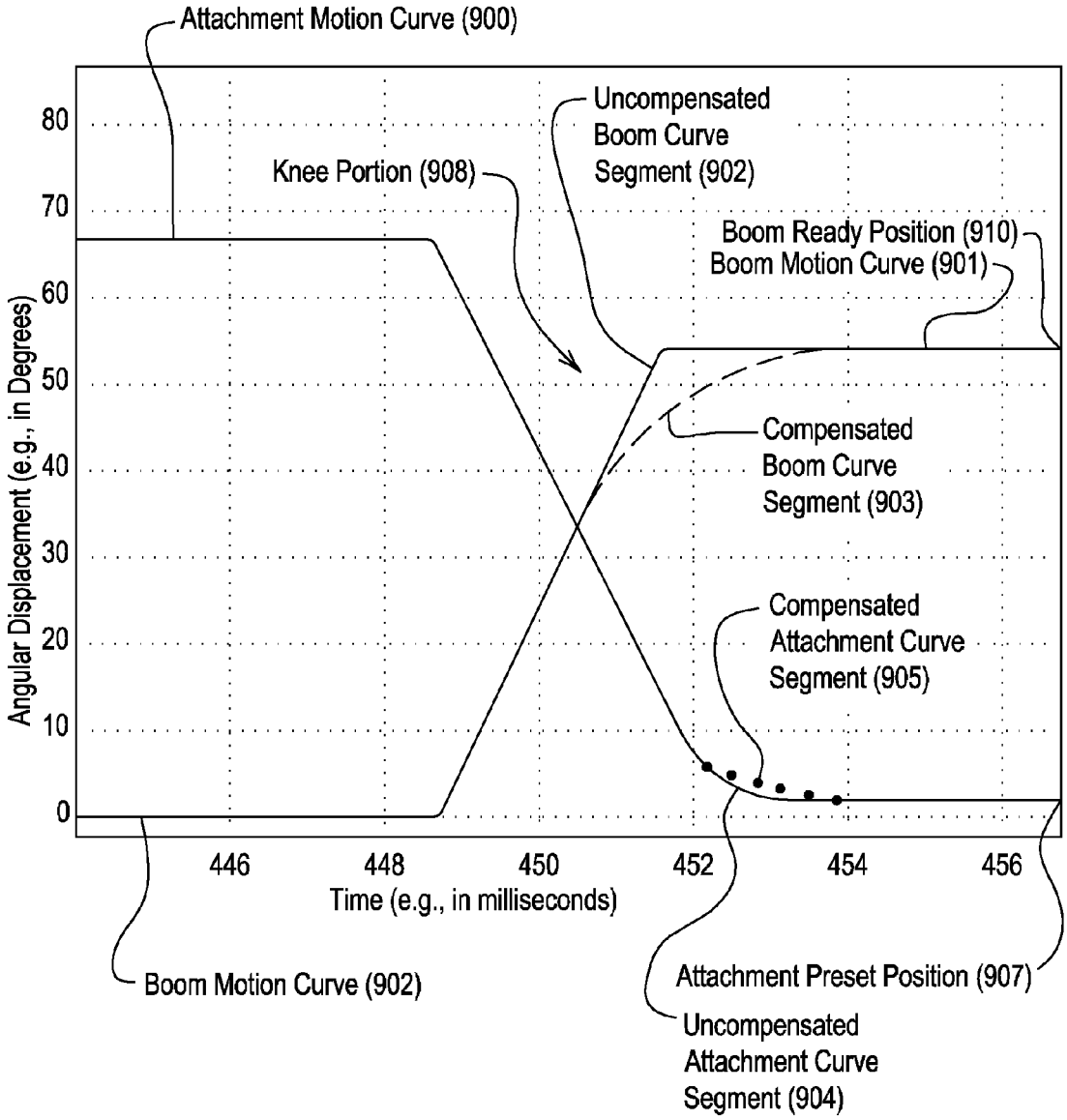
FIG. 10 is a graph of angular position versus time for a boom and angular position versus time for an attachment.

FIG. 10 is a graph of angular position versus time for a boom and angular position versus time for an attachment. The vertical axis of the graph represents angular displacement, whereas the horizontal axis of the graph represents time. For illustrative purposes, which shall not limit the scope of any claims, angular displacement is shown in degrees and time is depicted in milliseconds.

The graph shows an attachment motion curve 900 that illustrates the movement of the attachment 251 (e.g., bucket) over time. The attachment motion curve 900 has a transition from an attachment starting position (906) to an attachment preset position (907) of the attachment 251 (e.g., bucket). The controller 20 and the control system may control the movement of the attachment 251 to conform to an uncompensated attachment motion curve segment 904 in the vicinity of the transition or a compensated attachment motion curve segment 905 in the vicinity of the transition. The compensated attachment motion curve segment 905 is shown as a dotted line in FIG. 10. In one embodiment, the controller 20 uses acceleration data or an acceleration signal from an accelerometer (e.g., accelerometer 26 in FIG. 11) to control the attachment 251 to conform to the compensated attachment motion curve segment 905.

The compensated attachment motion curve segment 905 provides a smooth transition between a starting state (e.g., attachment starting position 906) and the ready state (e.g., attachment preset position 907). For example, the compensated attachment motion curve segment 905 may gradually reduce the acceleration or gradually increase the deceleration of the attachment 251 (e.g., bucket) rather than coming to an abrupt stop which creates vibrations and mechanical stress on the vehicle, or its components. The ability to reduce the acceleration or increase the deceleration may depend upon the mass or weight of the attachment 251 and its instantaneous momentum, among other things. Reduced vibration and mechanical stress is generally correlated to greater longevity of the vehicle and its constituent components.

A boom motion curve 901 illustrates the movement of the boom 252 over time. The boom motion curve 901 has a knee portion 908 that represents a transition from a boom starting position 909 to a boom preset position 910 of the boom 252. The controller 20 and the control system may control the movement of the boom 252 to conform to an uncompensated boom motion curve segment 902 in the vicinity of the knee portion 908 or a compensated boom motion curve segment 903 in the vicinity of the knee portion 908. The compensated boom motion curve segment 903 is show as dashed lines.

The compensated boom motion curve segment 903 provides a smooth transition between a starting state (e.g., boom starting position 909) and the ready state (e.g., boom preset position 910). For example, the compensated boom motion curve segment 903 may gradually reduce the acceleration of the boom 252 rather than coming to an abrupt stop which creates vibrations and mechanical stress on the vehicle, or its components. Reduced vibration and mechanical stress is generally correlated to greater longevity of the vehicle and its constituent components.

The controller 20 may store one or more of the following: the boom motion curve 901, the compensated boom motion curve segment 903, the uncompensated boom curve segment 902, the attachment motion curve 900, uncompensated attachment curve segment 904, the compensated attachment motion curve segment 905, motion curves, acceleration curves, position versus time curves, angle versus position curves or other reference curves or another representation thereof. For instance, another representation thereof may represent a data file, a look-up table, or an equation (e.g., a line equation, a quadratic equation, or a curve equation).

Figure 11:
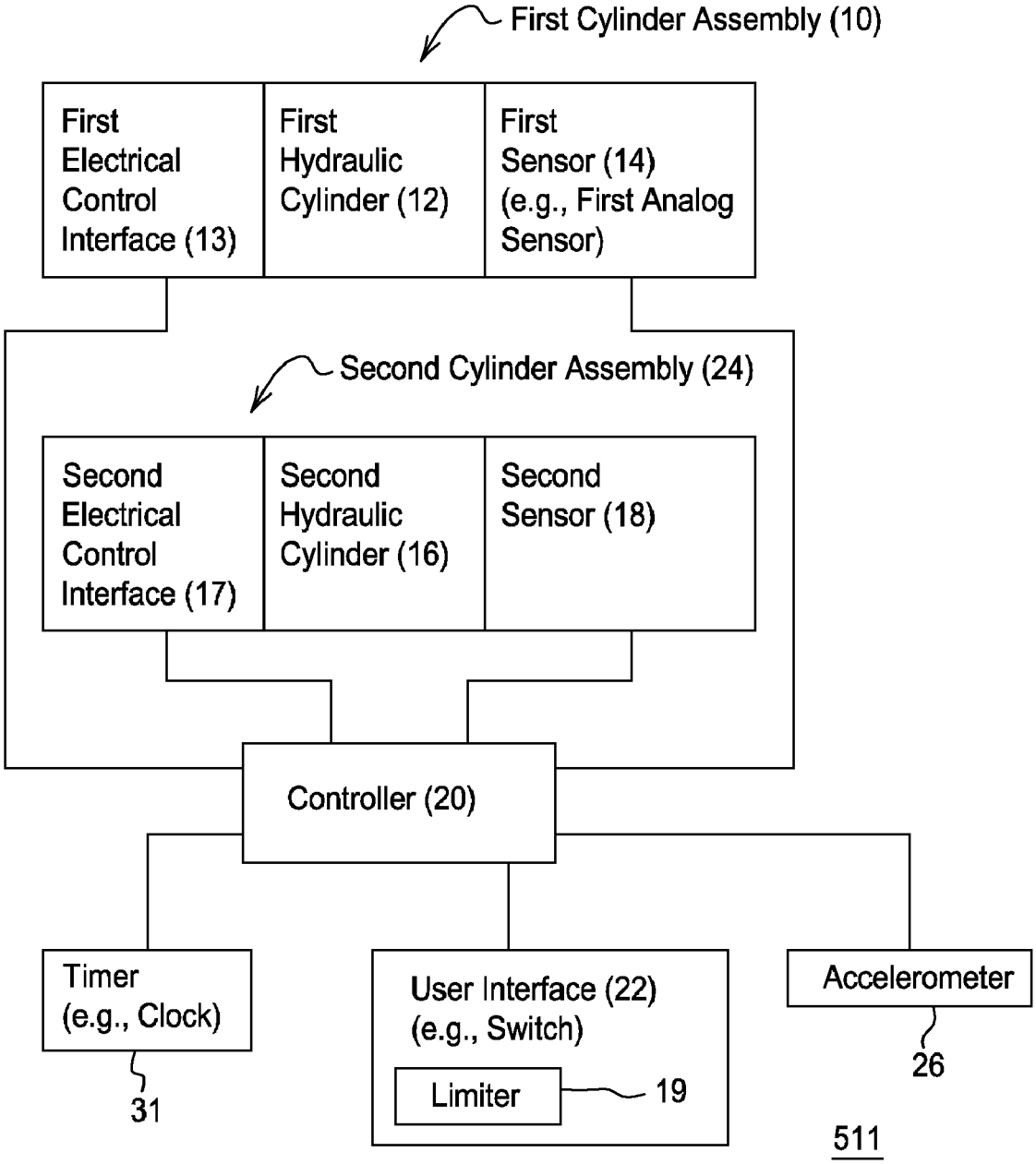
FIG. 11 is a block diagram of an alternate embodiment of a control system for a boom and attachment of a work vehicle.

The control system 511 of FIG. 11 is similar to the control system 11 of FIG. 1, except the control system 511 of FIG. 11 further includes an accelerometer 26. The accelerometer 26 is coupled to the controller 20. Like reference numbers in FIG. 1 and FIG. 11 indicate like elements. The accelerometer 26 provides an acceleration signal, a deceleration signal, acceleration data or deceleration data to the controller 20. Accordingly, the controller 20 may use the acceleration signal, acceleration data, deceleration signal, or deceleration data to compare the observed acceleration or observed deceleration to a reference acceleration data, reference deceleration data, a reference acceleration curve, a reference deceleration curve, or a reference motion curve (e.g., any motion curve of FIG. 10).

Figure 12:
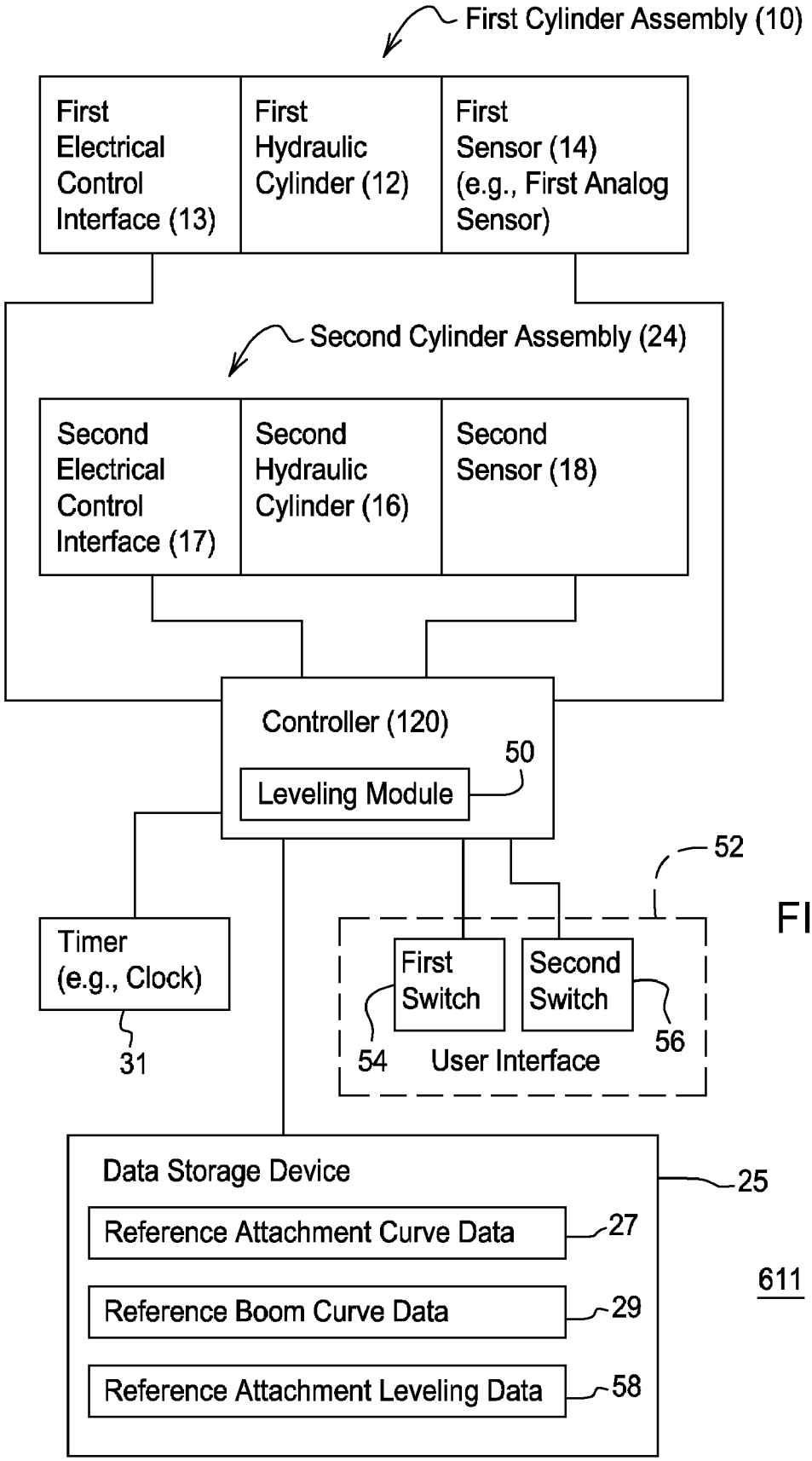
FIG. 12 is a block diagram of another alternative embodiment of a control system for a boom and an attachment of a work vehicle.

The control system 611 of FIG. 12 is similar to the control system 11 of FIG. 1, except the control system 611 of FIG. 12 for the following: (1) a controller 120 comprises a leveling module 50, (2) a user interface 52 comprises at least a first switch 54 and a second switch 56, (3) a data storage device 25 is associated with the controller 120.

In one embodiment, the leveling module 50 facilitates adjustment of the attachment angle of the attachment (e.g., bucket) with respect to the boom (e.g., 252) to maintain the attachment (e.g., 251 or the bucket) in a desired orientation (e.g., level to avoid spilling material in the bucket), regardless of movement or position of the boom (e.g., 252). The desired orientation of the attachment 251 may represent a top of a bucket that is generally horizontal or level or another level axis associated with the attachment 251, for instance. The leveling module 50 supports adjustment of the attachment (e.g., 251) in real time, contemporaneously with movement of the boom (e.g., 252) by the operator or during execution of a return to position or a preset position. The leveling module 50 generates control data or a control signal to maintain a generally constant angle of the level axis with respect to ground, and compensates for any material changes in the boom angle of the boom 252 to maintain the generally constant angle. For example, the leveling module 50 supports an anti-spill feature for a bucket that is moved (e.g., raised or lowered) from an initial position to a preset position.

In one embodiment, the leveling module 50 or controller 120 may update control data or control signals for controlling the attachment position (e.g., bucket position or attachment angle) with a minimum update frequency that is proportional to the rate of movement (e.g., velocity or acceleration) of the boom via control data or control signals provided to the first electrical control interface 13, the second electrical control interface 17, or both. For example, the greater the rate of movement, the higher the minimum update frequency of control data or control signals to the second electrical control interface 17 (or a solenoid, actuator, or electromechanical valve associated with the second hydraulic cylinder 16) is to keep the attachment substantially level or from tipping to spill material. In another embodiment, the leveling module 50 may update the attachment position (e.g., bucket position or attachment angle) with an update frequency of the control data or control signals that is proportional to rate of angular displacement of the boom.

The first switch 54 and the second switch 56 may comprise switches that activate or deactivate the first cylinder assembly 10, the second cylinder assembly 24, or both to move the boom 252 and attachment 251 to one or more preset positions. For example, the first switch 545 may activate the first cylinder assembly 10, the second cylinder assembly 24, or both to move the boom 252 and attachment 251 to a first preset position, whereas the second switch 56 may activate the first cylinder assembly 10, the second cylinder assembly 24, or both to move the boom 252 and attachment 251 to a second preset position. In one configuration, one or more switches (54, 56) of the user interface 52 may indicate that preset positions are stored in the data storage device 25 or memory associated with the controller 120 by a light emitting diode, a light, a display icon, or another indicator. The user interface 52 may include additional switches or input/output devices (e.g., joystick) for an operator to enter or select commands, for instance.

In an alternate embodiment, the user interface 52 supports an operator's entry, selection or input of one or more preset positions, where each preset position may be defined by one or more of the following: an attachment angle, an attachment angular range, a boom angle, a boom angular range, an attachment position, and a boom position.

The data storage device 25 stores one or more of the following: reference attachment leveling data, reference acceleration data, reference deceleration data, a reference acceleration curve, a reference deceleration curve, a reference motion curve (e.g., any motion curve of FIG. 10), reference attachment curve data 27, reference boom curve data 29, a database, a look-up table, an equation, and any other data structure that provides equivalent information. The reference attachment leveling data may provide a desired relationship between a boom angle and a corresponding attachment angle at any given time, where the boom is lowered, raised or held at a steady or constant height above ground. Further, the reference attachment leveling data may vary based on an initial position and a preset position that is a target position or final position. The attachment angle compensates for boom movement to keep the attachment (e.g., bucket) in a desired orientation (e.g., level to avoid spilling material in the bucket).

The reference attachment curve data 27 refers to a reference attachment command curve, a reference attachment motion curve (e.g., any attachment motion curve of FIG. 10), or both. The reference attachment curve 27 stored in the data storage device 25 may comprise the attachment motion curve 900 or the compensated attachment curve segment 905 of FIG. 10, for example. The reference boom curve data 29 refers to a reference boom command curve, a reference boom motion curve (e.g., any boom motion curve of FIG. 10), or both. The reference boom curve data 29 stored in the data storage device 25 may comprise the boom motion curve 901 or the compensated boom curve segment 903 of FIG. 10, for example.

The reference boom command curve refers to a control signal that when applied to the first electrical control interface 13 of the first hydraulic cylinder 12 yields a corresponding reference boom motion curve (e.g., 901). The reference attachment command curve refers to a control signal that when applied to the second electrical control interface 17 of the second hydraulic cylinder 16 yields a corresponding reference attachment motion curve.

The controller 20 controls the first hydraulic cylinder 12 to move the boom 252 to achieve a desired boom motion curve. In one example, the controller 20 may reference or retrieve desired boom motion curve from the data storage device 25 or a corresponding reference boom command curve stored in the data storage device 25. In another example, the controller 20 may apply a compensated boom motion curve segment, which is limited to a maximum deceleration level, a maximum acceleration level, or both, to control the boom 252.

The controller 20 controls the second hydraulic cylinder 16 to move the attachment 251 (e.g., bucket) to achieve a desired attachment motion curve. In one example, the controller 20 may reference or retrieve desired attachment motion curve from the data storage device 25 or a corresponding reference attachment command curve stored in the data storage device 25. In another example, the controller 20 may apply a compensated attachment motion curve segment, which is limited to a maximum deceleration level, a maximum acceleration level, or both, to control the attachment 251 (e.g., attachment).

Figure 13:
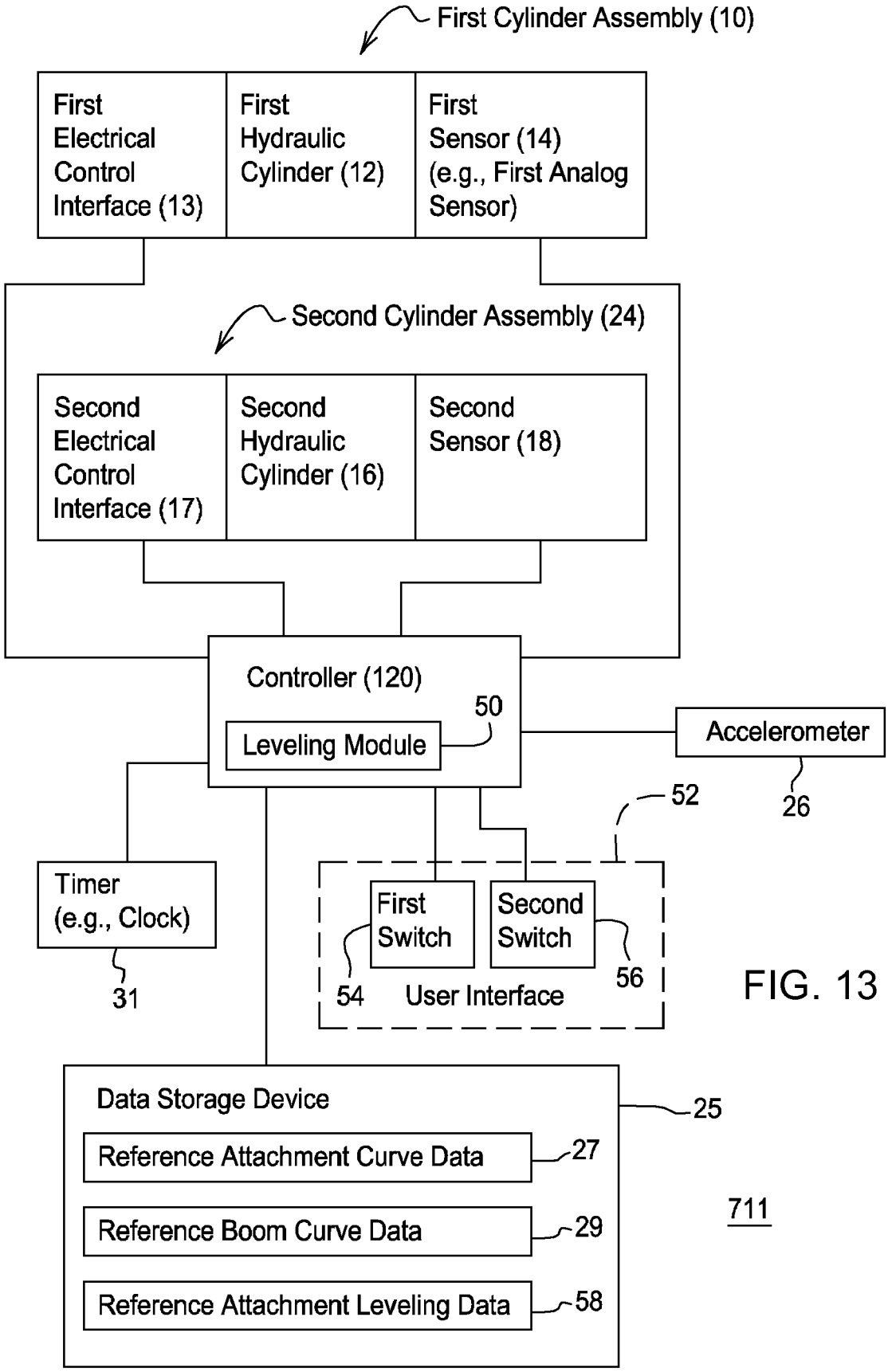
FIG. 13 is a block diagram of yet another alternative embodiment of a control system for a boom and an attachment of a work vehicle.

The control system 711 of FIG. 13 is similar to the control system 611 of FIG. 12, except the control system 711 of FIG. 13 further includes an accelerometer 26. Like reference numbers in FIG. 11, FIG. 12 and FIG. 13 indicate like elements. The accelerometer 26 provides an acceleration signal, a deceleration signal, acceleration data or deceleration data to the controller 120. Accordingly, the controller 120 may use the acceleration signal, acceleration data, deceleration signal, or deceleration data to compare the observed acceleration or observed deceleration to a reference acceleration data, reference deceleration data, a reference acceleration curve, a reference deceleration curve, or a reference motion curve (e.g., any motion curve of FIG. 10).

Figure 14:
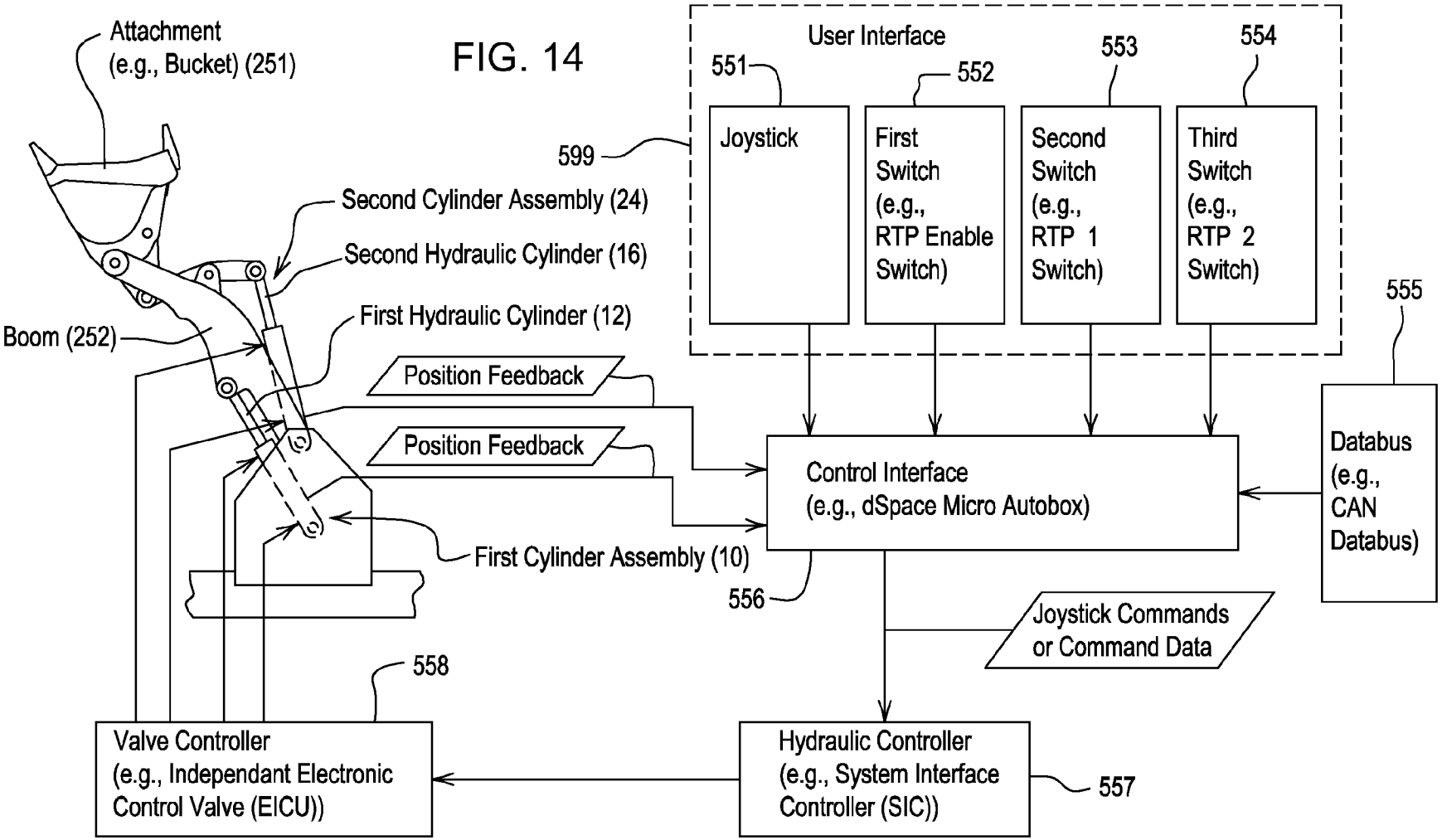
FIG. 14 is a block diagram of still another alternative embodiment of a control system for a boom and attachment of a work vehicle.

FIG. 14 is a block diagram of still another alternative embodiment of a control system for a boom 252 and attachment 251 of a work vehicle. A user interface 599 accepts inputs (e.g., commands) from an operator of a work vehicle. The user interface 599 provides input data to the control interface 556. The control interface 556 is associated with a databus 555, such as a CAN (controller area network) databus, which supports communication with other controllers, sensors, actuators, devices, and network elements associated with the work vehicle. For example, the databus 55 may communicate with a ground speed sensor that provides a speed or velocity of the vehicle relative to the ground.

The control interface 556 may comprise a controller, a microcontroller, a microprocessor, a logic circuit, a programmable logic array, or another data processor (e.g., dSpace Micro Autobox or another controller). The control interface 556 provides output data (e.g., joystick commands or command data) to a hydraulic controller 557. In one illustrative embodiment, the hydraulic controller 557 comprises a system interface controller (SIC). The hydraulic controller 557 or system interface controller monitors one or more vehicle systems via sensors (e.g., current sensors, voltage detectors, temperature sensors or hydraulic sensors). The hydraulic controller 557 communicates with the valve controller 558. In turn, the valve controller 558 may control one or more valves or electrical control interfaces (e.g., solenoids, actuators, or electromechanical devices) associated with the first cylinder assembly 10, the second cylinder assembly 24, or both. The first hydraulic cylinder 12 is associated with a boom 252 and is operably connected to the boom 252 to facilitate raising and lowering of the boom 252. The second hydraulic cylinder 16 is associated with an attachment 251 (e.g., bucket).

The user interface 599 may comprise one or more switches (552, 553, 554), a joystick 551, a keypad, a keyboard, a pointing device (e.g., trackball or electronic mouse) or another input device. As shown in FIG. 14, the switches comprise a first switch 552 (e.g., return-to-position enable switch), a second switch 553 (e.g. a return-to-position one switch) and a third switch 554 (e.g., a return-to-position two switch). One switch (e.g., the first switch 552) may enable or disable the return-to-position functionality (or command data) that automatically returns the boom, bucket, or both to a preset position, whereas the other switches (e.g., second switch 553 and third switch 554) may correspond to preset positions that are established by the operator or as factory settings. In one embodiment, the operator may establish or program a preset position via the user interface 551 by first moving the boom, the bucket, or both to a target or desired preset position and activating a switch (e.g., 553 or 554) in an appropriate manner (e.g., pressing a switch for minimum duration) to store the preset position in memory or data storage associated with the controller of the return-to-position system. If a preset position switch (e.g., 553 or 554) of the user interface 599 is activated (e.g., pressed, flipped, pushed, toggled, or otherwise turned on) and if the return to position is enabled (e.g., via the first switch 552), one or more controllers (556, 557 and/or 558) controls the first cylinder assembly 10, the second cylinder assembly 24, or both, to move the boom 252 to a preset boom angle and the attachment 251 to a preset attachment angle.

In an alternate embodiment of the user interface 599, the switch (e.g., first switch 552) that enables or disables the return-to-position functionality comprises a semiconductor device or other switch that is not accessible to or under the dominion of the operator, but rather that associated with an output of a receiver, a transceiver, a communications device, or a telematics device that operates (e.g., switches on or off) the semiconductor device upon the receipt (e.g., detection, decryption, decoding or acknowledgement) of a particular code, sequence, or key. Therefore, under such an arrangement, the return-to-position position functionality may be enabled or disabled, remotely or via a technician, based on the payment of a subscription fee, a license fee, or an option fee to the equipment supplier.

The control interface 556 may receive position feedback data (e.g., boom angle data, attachment angle data, or both) from one or more position sensors associated with the first hydraulic cylinder 12 and the second hydraulic cylinder 16. The control interface 556 may send or transmit output data (e.g., standard or simulated joystick commands) to the hydraulic controller 557. The hydraulic controller 557 has an input for standard joystick commands, or another suitable communications interface for communicating with the control interface 556. The valve controller 558 controls one or more of the following valves of the hydraulic cylinders by electromechanical devices, stepper motors, or other actuators: attachment valve, boom valve, attachment curl valve, attachment dump valve, boom up valve, and boom down valve. The valve controller 558 regulates the flow of hydraulic fluid consistent with the movement of the boom 252 or attachment 251 (e.g., bucket) from an initial position to a preset position, for instance.

Figure 15:
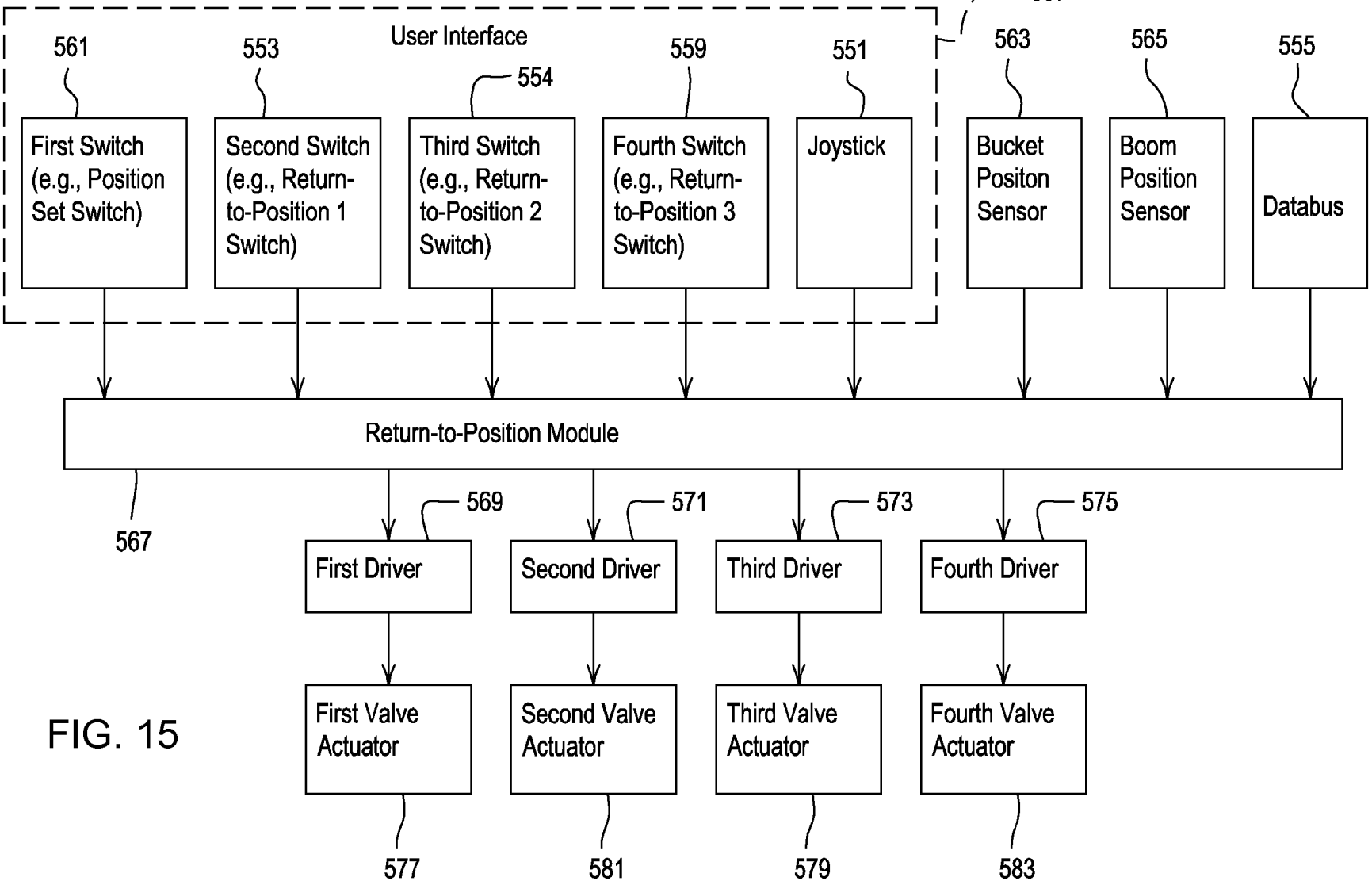
FIG. 15 is a block diagram of inputs and outputs to a return-to-position module which may be associated with a controller.

FIG. 15 is a block diagram of inputs and outputs to a return-to-position module 567, which may be associated with a controller (e.g., controller 20, 120 or controllers associated with FIG. 14) of any embodiment disclosed in this document.

A user interface 597 allows an operator to enter, select or provide input data (e.g., command data or a command) to a return-to-position module 567. Here, the user interface 597 comprises one or more of the following: a first switch 561 (e.g., position set switch), a second switch 553 (e.g., return to position 1 switch), a third switch 554 (e.g., return to position 2 switch), a fourth switch 559 (e.g., return to position 3 switch), and a joystick 551. A bucket position sensor 563 may provide bucket position data as input data to the return-to-position module 567. A boom position sensor 565 may provide boom position data as input data to the return-to-position module 567. The return-to-position module 567 may also communicate with a databus, such as a CAN (controller area network) databus to receive or send data messages or data associated with a controller, sensor (e.g., hydraulic fluid temperature sensor), actuator, or other network device or element.

The return-to-position module 567 provides output data or control data to one or more of the following components: a first driver 569, a second driver 571, a third driver 573, and a fourth driver 559 for driving one or more electro-hydraulic valves, actuators, stepper motors, servo-motors or electromechanical devices associated with one or more valves of the first hydraulic cylinder (e.g., 12), the second hydraulic cylinder (e.g., 16), or both. The first driver 569 provides a control signal for the first valve actuator 577; the second driver 571 provides a control signal for the second valve actuator 571; the third driver 573 provides a control signal for the third valve actuator 579; and the fourth driver 559 provides a control signal for the fourth valve actuator 583. In one embodiment, the first driver 569 comprises a current driver for a bucket dump electrohydraulic valve actuator as the first valve actuator 577; the second driver 571 comprises a current driver for bucket curl electrohydraulic valve actuator as the second valve actuator 581; the third driver 573 comprises a current driver for a boom down electrohydraulic valve actuator as the third valve actuator 579; the fourth driver 559 comprises a current driver a boom up electrohydraulic valve actuator as the fourth valve actuator 583. The valve actuators (577, 581, 579, and 583) may comprise solenoids, stepper motors, servo-motors or other electromechanical devices, for instance. In one embodiment, drivers (569, 571, 573, and 575) comprise temperature compensation modules to compensate for changes and flow characteristics that vary with the temperature of hydraulic oil.

Figure 16:
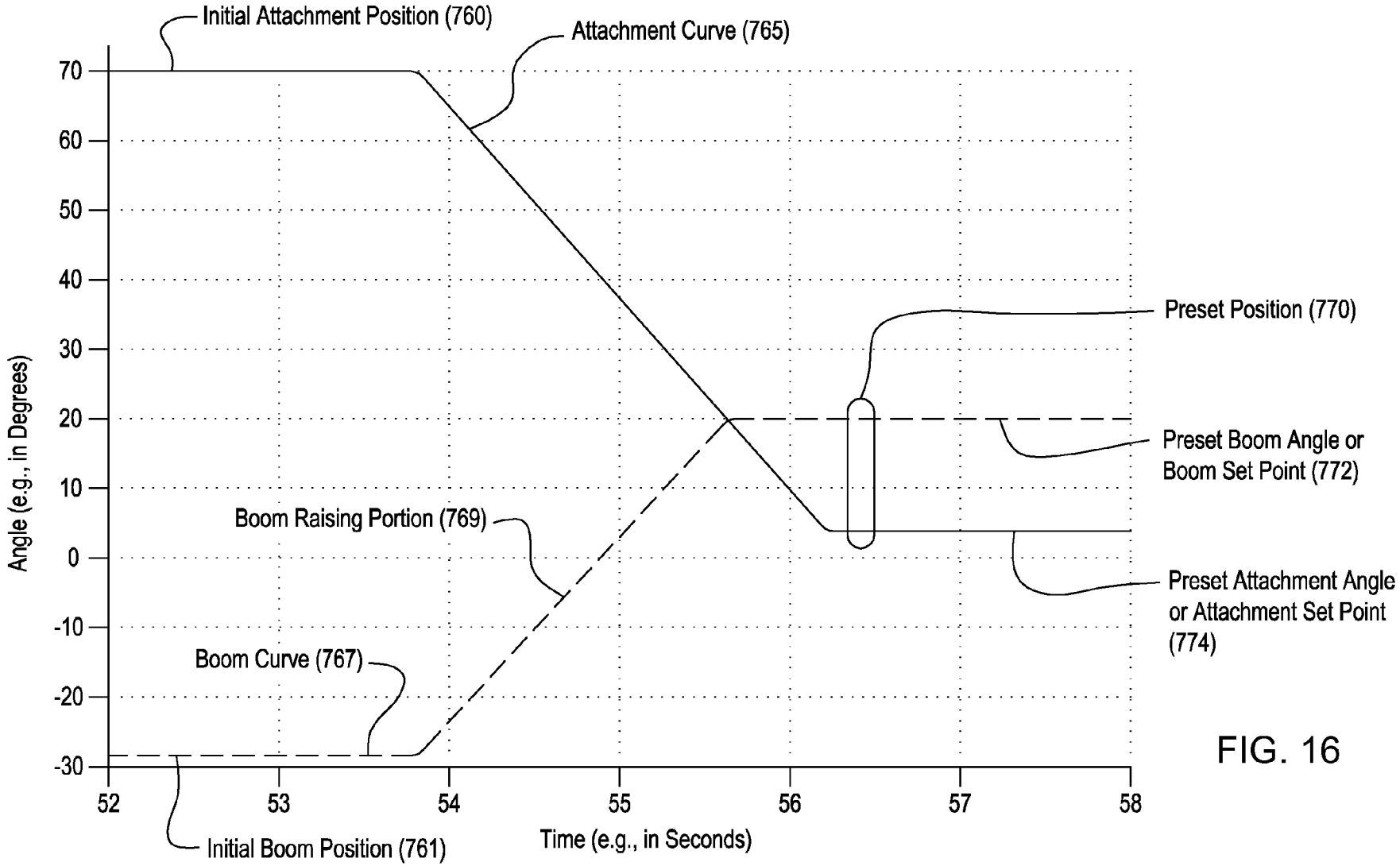
FIG. 16 illustrates a graph of boom angle and attachment angle versus time associated with a return to a preset position (e.g., ready-to-dump position).

FIG. 16 illustrates a graph of boom angle and attachment angle versus time associated with a return to a preset position (e.g., ready-to-dump position). The vertical axis represents angle (e.g., in degrees), whereas the horizontal axis represents time (e.g. in seconds). The attachment curve 765 shows the transition of the attachment angle over time from an initial attachment position 760 to a preset position 770. The attachment begins at an initial attachment position 760 (e.g., initial attachment angle) and reaches a preset attachment angle 774 (e.g., preset attachment angle or attachment set point). The boom curve 767 shows the transition of the boom angle over time from an initial boom position 761 to a preset position 770. The boom begins at an initial boom position 761 (e.g., initial boom angle) and reaches a preset boom angle 772 (e.g., preset boom angle or preset boom set point). The preset boom angle 772 and the preset attachment angle 774 are collectively referred to as the preset position 770.

The controller 20 or 120 (deliberately or actively) rotates the attachment 251 (e.g., bucket) to set level position to avoid spillage of material in the attachment 251, when the boom 252 is raised in FIG. 16. Active rotation of the attachment 251 means that the controller (20 or 120) controls the second hydraulic cylinder 16 to move the attachment 251 in accordance with a desired level position or the level axis with respect to ground in response to any material movement of the boom 252, as previously described herein. As illustrated in FIG. 16, the attachment curve 765 corresponds to the boom raising portion 769 of the boom curve 767 to avoid spillage of material in the attachment.

Figure 17:
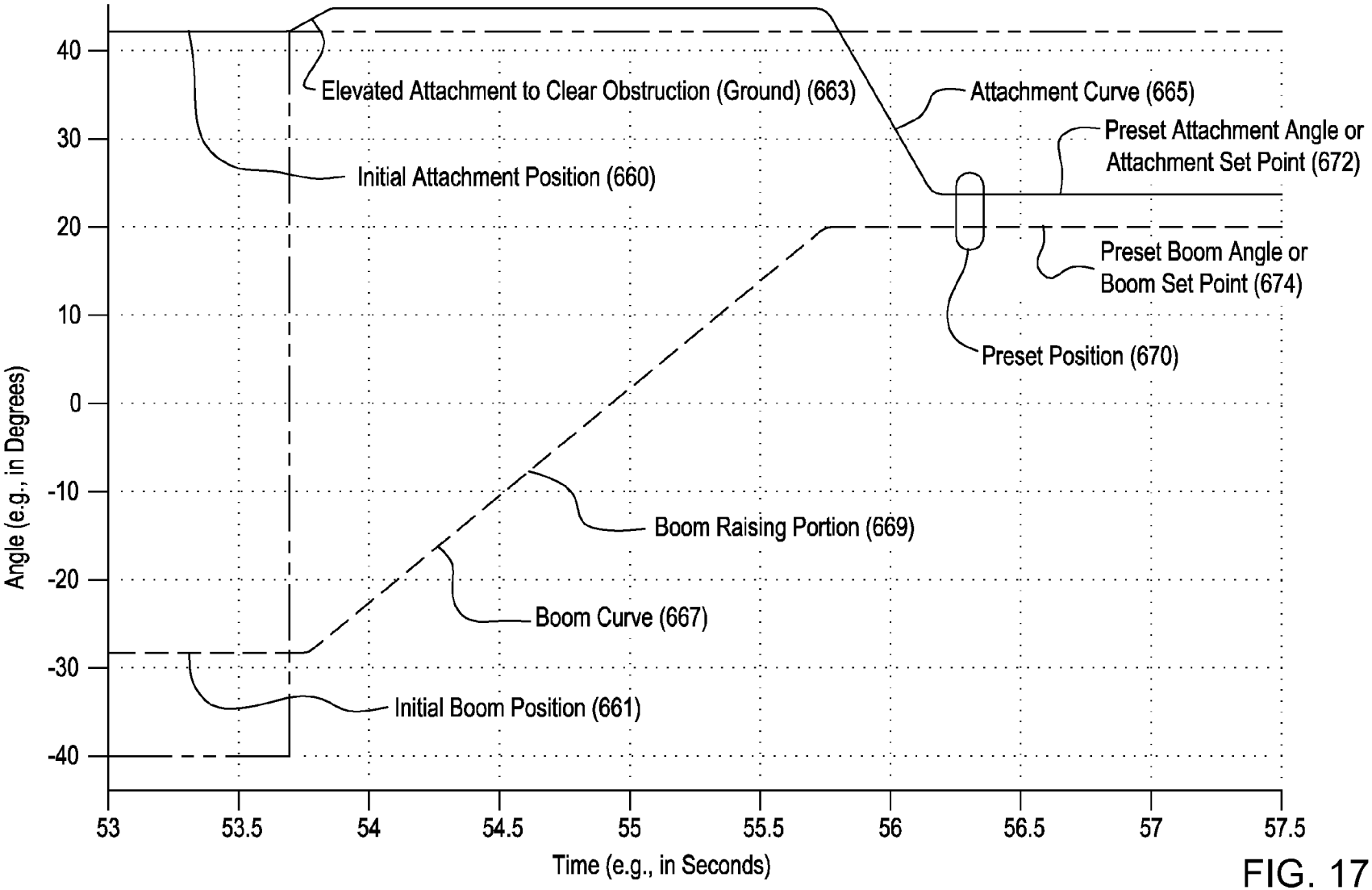
FIG. 17 illustrates a graph of boom angle and attachment angle versus time associated with a return to another preset position.

FIG. 17 illustrates a graph of boom angle and attachment angle versus time associated with a return to another preset position (e.g. higher ready to dump position than that of FIG. 16). The vertical axis represents angle (e.g., in degrees), whereas the horizontal axis represents time (e.g. in seconds).

The attachment curve 665 shows the transition of the attachment angle over time from an initial attachment position 660 to a preset position 670 (e.g., preset attachment angle 672). The attachment begins at an initial attachment position 660 (e.g., initial attachment angle) and reaches a preset attachment angle 672 (e.g., preset attachment angle or preset attachment set point). Initially, as shown in FIG. 17, the attachment may be elevated from its initial attachment position 660 to an elevated attachment position 663 to clear an obstruction (e.g., the ground). For example, if the attachment is a bucket that is fully dumped at ground level, the boom may be raised prior to curling to prevent a cutting edge of the bucket from hitting or contacting the ground. The boom curve 667 shows the transition of the boom angle over time from an initial boom position 661 to a preset position 670 (e.g., preset boom angle). The boom begins at an initial boom position 661 (e.g., initial boom angle) and reaches a preset boom angle 674 (e.g., preset boom angle or boom set point). The preset attachment angle 672 and the preset boom angle 674 are collectively referred to as the preset position. The boom 252 is raised during a boom raising portion of the curve. As the boom 252 is raised, the attachment angle associated with the attachment curve is contemporaneously adjusted to avoid spilling any material within the attachment 251 (e.g., bucket).

The controller 20 or 120 (deliberately or actively) rotates the attachment (e.g., bucket) to set level position to avoid spillage of material in the attachment 251, when the boom 252 is raised in FIG. 17. Active rotation of the attachment 251 means that the controller (20 or 120) controls the second hydraulic cylinder 16 to move the attachment 251 in accordance with a desired level position or the level axis with respect to ground in response to any material movement of the boom 252, as previously described herein. As illustrated in FIG. 17, the attachment curve 765 corresponds to the boom raising portion 769 of the boom curve 767 to avoid spillage of material in the attachment.

Having described the preferred embodiment, it will become apparent that various modifications can be made without departing from the scope of the invention as defined in the accompanying claims.

The following is claimed:

1. A system for automated operation of a work vehicle, the system comprising:

a boom having a first end and a second end opposite the first end;

a first hydraulic cylinder associated with the boom;

a first sensor for detecting a boom angle of the boom with respect to a support near the first end;

an attachment coupled to the second end of the boom;

a second hydraulic cylinder associated with the attachment;

a second sensor for detecting an attachment angle of the attachment with respect to the boom;

a switch for accepting a command to enter a preset position from another position;

a controller for controlling the first hydraulic cylinder to attain a boom angle within a target boom angular range and for controlling the second cylinder to attain an attachment angle within a target attachment angular range associated with the preset position in response to the command; and a leveling module for updating control data for controlling the attachment angle of the attachment within a minimum update frequency that is proportional to at least one of acceleration and velocity of the boom.

2. The system according to claim 1 further comprising:

a user interface associated with the switch, the controller overriding the command based on manual input from an operator via the user interface.

3. The system according to claim 1 further comprising:

a limiter for limiting the preset position based on at least one of a maximum rollback angle of the attachment and a cutting edge position of the attachment.

4. The system according to claim 1 wherein the controller controls the first hydraulic cylinder and the second hydraulic cylinder to move the boom and the attachment simultaneously.

5. The system according to claim 1 wherein the controller controls the first hydraulic cylinder to move the boom to achieve a desired boom motion curve.

6. The system according to claim 1 wherein the controller controls the second hydraulic cylinder to move the attachment to achieve a desired attachment motion curve.

7. The system according to claim 1 wherein the attachment comprises one of the following: a bucket, a loader, a grapper, jaws, claws, a cutter, a grapple, an asphalt cutter, an auger, compactor, a crusher, a feller buncher, a fork, a grinder, a hammer, a magnet, a coupler, a rake, a ripper, a drill, shears, a tree boom, a trencher, and a winch.

8. The system according to claim 1 wherein if the boom or attachment does not reach the preset position within a maximum time duration, the controller cancels the command.

9. The system according to claim 8 wherein the preset position is defined as a boom preset angle and an attachment preset angle.

10. The system according to claim 1 wherein the attachment comprises a bucket and wherein the target attachment angular range and a target boom angular range is consistent with a respective ready state associated with completion of a corresponding return-to-dig procedure.

11. The system according to claim 1 wherein the leveling module further updates control data for controlling the attachment angle of the attachment to maintain the attachment within a desired level state when a boom is lowered, raised, or held steady.

12. The system according to claim 1 wherein the preset position comprises one or more of the following: a lower boom position, an elevated boom position, a bucket curl position, a material-carrying or level position of a bucket, a ready-to-dig position, a ready position, a return-to-dig position, a curl position of an attachment, a lower ready-to-dig position, an elevated ready-to-dig position, a lower curl position, an elevated curl position, a ready-to-dump position, a dump position, a lower dump position, and an elevated dump position.

13. The system according to claim 1 wherein the preset position is defined by one or more of the following: an attachment angle, an attachment angular range, a boom angle, and a boom angular range, a boom position, a boom position range, an attachment position, and an attachment position range.

14. A method for automated operation of a work vehicle, the method comprising:

establishing a preset position associated with at least one of a target boom angular range of a boom and a target attachment angular range of an attachment;

detecting a boom angle of the boom with respect to a support near one end of the boom;

detecting an attachment angle of the attachment with respect to another end of the boom;

facilitating a command to enter a preset position state or preset position from another position state;

controlling a first hydraulic cylinder associated with the boom to attain a boom angle within the target boom angular range and for controlling the second hydraulic cylinder associated with the attachment to attain an attachment angle within the target attachment angular range associated with the preset position state in response to the command; and updating control data for controlling the attachment angle of the attachment within a minimum update frequency that is proportional to at least one of acceleration and velocity of the boom.

15. The method according to claim 14 further comprising:

overriding the command based on manual input from an operator via a user interface.

16. The method according to claim 14 further comprising:

limiting the preset position based on at least one of a maximum rollback angle of the attachment and a cutting edge position of the attachment.

17. The method according to claim 14 wherein the controlling comprises controlling the first hydraulic cylinder and the second hydraulic cylinder to move the boom and the attachment simultaneously.

18. The method according to claim 14 wherein the controlling comprises controlling the first hydraulic cylinder to move the boom to achieve a desired boom motion curve.

19. The method according to claim 14 wherein the controlling comprises controlling the second hydraulic cylinder to move the attachment to achieve a desired attachment motion curve.

20. The method according to claim 14 further comprising:

canceling the command if the boom or attachment does not reach the preset position within a maximum time duration.

21. The method according to claim 14 wherein the preset position is defined as a boom preset angle and an attachment preset angle.

22. The method according to claim 14 wherein the attachment comprises a bucket and wherein the target attachment angular range and a target boom angular range is consistent with a respective ready state associated with completion of a corresponding return-to-dig procedure.

23. The method according to claim 14 further comprising:

further updating the control data for controlling an attachment angle of the attachment to maintain the attachment within a desired level state when a boom is lowered, raised, or held steady.

24. The method according to claim 14 wherein the preset position comprises one or more of the following: a lower boom position, an elevated boom position, a bucket curl position, a material-carrying or level position of a bucket, a ready-to-dig position, a ready position, a return-to-dig position, a curl position of an attachment, a lower ready-to-dig position, an elevated ready-to-dig position, a lower curl position, an elevated curl position, a ready-to-dump position, a dump position, a lower dump position, and an elevated dump position.

25. The method according to claim 14 further comprising:

defining the preset position by one or more of the following: an attachment angle, an attachment angular range, a boom angle, and a boom angular range, a boom position, a boom position range, an attachment position, and an attachment position range.

* * * * *